US011384462B2

(12) United States Patent
Samarasinghe et al.

(10) Patent No.: US 11,384,462 B2
(45) Date of Patent: Jul. 12, 2022

(54) TREATING BASE TEMPLATES WITH ANTI-OZONE AGENT BEFORE STORAGE FOR LASER FINISHING

(71) Applicant: Levi Strauss & Co., San Francisco, CA (US)

(72) Inventors: Sachith Devendra Samarasinghe, Ragama (LK); Chatura Atukorala, Veyangoda (LK); James Barton Sights, San Francisco, CA (US); David Love, Tiburon, CA (US); Elizabeth O'Neill, Tiburon, CA (US); Jeff Zens, Emeryville, CA (US); Benjamin Bell, San Francisco, CA (US); Jennifer Schultz, Cambridge, MA (US); Christopher Schultz, Cambridge, MA (US); Debdulal Mahanty, Fremont, CA (US)

(73) Assignee: Levi Strauss & Co., San Francisco, CA (US)

( * ) Notice: Subject to any disclaimer, the term of this patent is extended or adjusted under 35 U.S.C. 154(b) by 0 days.

(21) Appl. No.: 16/794,185

(22) Filed: Feb. 18, 2020

(65) Prior Publication Data

US 2020/0263354 A1 Aug. 20, 2020

Related U.S. Application Data

(60) Provisional application No. 62/806,713, filed on Feb. 15, 2019.

(51) Int. Cl.

| | |
|---|---|
| ***D06B 3/10*** | (2006.01) |
| ***D06B 9/04*** | (2006.01) |
| ***D06M 10/00*** | (2006.01) |
| ***D06M 10/08*** | (2006.01) |
| ***D06M 10/04*** | (2006.01) |
| ***D06P 5/04*** | (2006.01) |
| ***D06P 1/22*** | (2006.01) |

(52) U.S. Cl.

CPC ..... *D06B 3/10* (2013.01); *D06B 9/04* (2013.01); *D06M 10/005* (2013.01); *D06M 10/04* (2013.01); *D06M 10/08* (2013.01); *D06P 5/04* (2013.01); *D06P 1/228* (2013.01)

(58) Field of Classification Search

CPC ..... D06P 5/04; D06P 1/228; D06M 10/04; D06M 10/005; D06B 9/04

See application file for complete search history.

(56) References Cited

U.S. PATENT DOCUMENTS

| | | | | |
|---|---|---|---|---|
| 5,647,875 | A * | 7/1997 | Dixon | D06P 1/228 8/111 |
| 6,037,101 | A | 3/2000 | Telser et al. | |
| 2006/0058188 | A1 | 3/2006 | Tamagawa | |
| 2012/0244576 | A1 | 9/2012 | Bodie et al. | |
| 2014/0277663 | A1 * | 9/2014 | Gupta | G06Q 50/04 700/98 |
| 2016/0263928 | A1 * | 9/2016 | Costin, Jr | B41J 2/455 |
| 2017/0312365 | A1 | 11/2017 | Thaxton et al. | |
| 2018/0066395 | A1 | 3/2018 | Benefiel et al. | |
| 2018/0291553 | A1 * | 10/2018 | Schimper | D06P 5/13 |

FOREIGN PATENT DOCUMENTS

| | | |
|---|---|---|
| EA | 200501543 | 4/2006 |
| GB | 2458388 | 9/2009 |

OTHER PUBLICATIONS

Tyttialapieti, "Creating an Efficient and Scalable Manufacturing System for Customized Made-To-Measure Jeans", Master of Science thesis, 102 pgs., Tampere University of Technology, Finland, 2012, published online at: https://trepo.tuni.fl// handle/123456789/21068.*

International Search Report, PCT Application PCT/US2020/018705, dated Aug. 20, 2020, 3 pages.

* cited by examiner

*Primary Examiner* — Amina S Khan
(74) *Attorney, Agent, or Firm* — Aka Chan LLP

(57) ABSTRACT

Indigo-dyed garments are treated with an anti-ozone agent to prevent ozone-related degradation of the garments before laser finishing. Without treatment, the garments can exhibit color loss (e.g., color change or fading) from exposure to ozone in the atmosphere. The indigo-dyed garments with anti-ozone treatment can serve as base templates in a laser finishing process flow. The anti-ozone treatment of the base templates can include a rinse including an ascorbic acid or vitamin C constituent during a base preparation process. Then quantities of these base templates can manufactured and stored for periods of time without exhibiting ozone-related degradation effects.

29 Claims, 18 Drawing Sheets

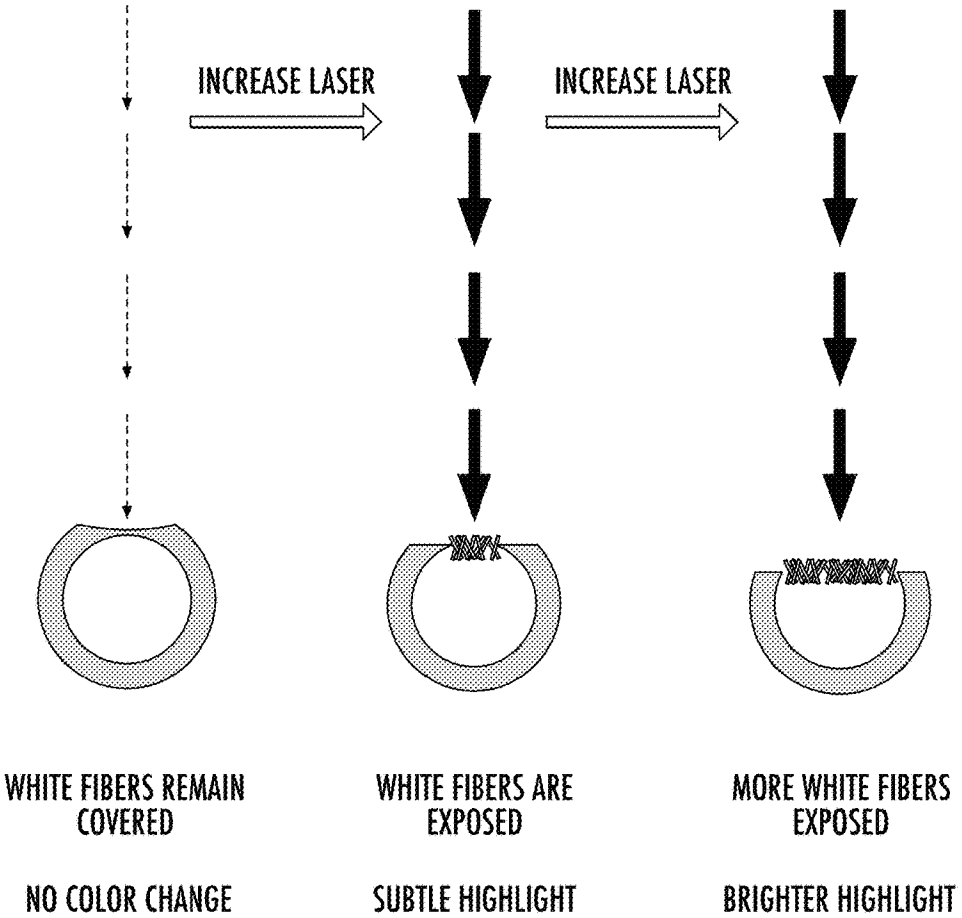
FIG. 12
FIG. 13
FIG. 14
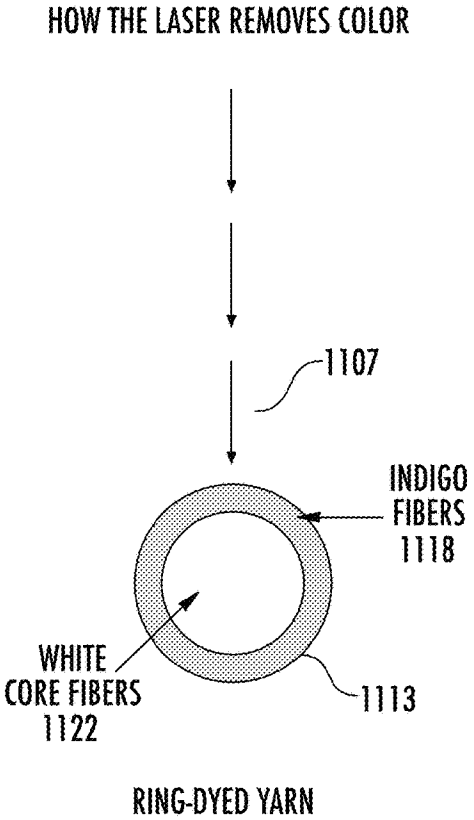
FIG. 11

TREATING BASE TEMPLATES WITH ANTI-OZONE AGENT BEFORE STORAGE FOR LASER FINISHING

CROSS-REFERENCE TO RELATED APPLICATIONS

This patent application claims the benefit of U.S. patent application 62/806,713, filed Feb. 15, 2019, which is incorporated by reference along with all other references cited in this application.

BACKGROUND OF THE INVENTION

The present invention relates to apparel manufacture, and, more specifically, processing of materials before laser finishing. The manufacture of the apparent can include the use of a laser in the finishing of garments, especially denim including jeans, shirts, shorts, jackets, vests, and skirts, to obtain a faded, distressed, washed, or worn finish or appearance.

In 1853, during the California Gold Rush, Levi Strauss, a 24-year-old German immigrant, left New York for San Francisco with a small supply of dry goods with the intention of opening a branch of his brother's New York dry goods business. Shortly after arriving in San Francisco, Mr. Strauss realized that the miners and prospectors (called the "forty niners") needed pants strong enough to last through the hard work conditions they endured. So, Mr. Strauss developed the now familiar jeans which he sold to the miners. The company he founded, Levi Strauss & Co., still sells jeans and is the most widely known jeans brand in the world. Levi's is a trademark of Levi Strauss & Co. or LS&Co.

Though jeans at the time of the Gold Rush were used as work clothes, jeans have evolved to be fashionably worn everyday by men and women, showing up on billboards, television commercials, and fashion runways. Fashion is one of the largest consumer industries in the U.S. and around the world. Jeans and related apparel are a significant segment of the industry.

As fashion, people are concerned with the appearance of their jeans. Many people desire a faded or worn blue jeans look. In the past, jeans became faded or distressed through normal wash and wear. The apparel industry recognized people's desire for the worn blue jeans look and began producing jeans and apparel with a variety of wear patterns. The wear patterns have become part of the jeans style and fashion. Some examples of wear patterns include combs or honeycombs, whiskers, stacks, and train tracks.

Despite the widespread success jeans have enjoyed, the process to produce modern jeans with wear patterns takes processing time, has relatively high processing cost, and is resource intensive. A typical process to produce jeans uses significant amounts of water, chemicals (e.g., bleaching or oxidizing agents), ozone, enzymes, and pumice stone. For example, it may take about 20 to 60 liters of water to finish each pair of jeans.

Therefore, there is a need for improved technique the manufacture of apparel, especially laser-finished apparel, including pants (e.g., jeans and khakis), clothing made from denim and other materials, and other garments. Laser finishing reduces environmental impact, processing time, and processing costs, while maintaining the look and style of traditional finishing techniques.

BRIEF SUMMARY OF THE INVENTION

Indigo-dyed garments are treated with an anti-ozone agent to prevent ozone-related degradation of the garments before laser finishing. Without treatment, the garments can exhibit color loss (e.g., color change or fading) from exposure to ozone in the atmosphere. The indigo-dyed garments with anti-ozone treatment can serve as base templates in a laser finishing process flow. The anti-ozone treatment of the base templates can include a rinse including an ascorbic acid or vitamin C constituent during a base preparation process. Then quantities of these base templates can manufactured and stored for periods of time without exhibiting ozone-related degradation effects.

In an implementation, a system includes a garment template that has been treated with at least one of ascorbic acid or sodium ascorbate as an anti-ozone treatment. The garment template is an assembled garment (e.g., jeans, jacket, shorts, or other garment) made from fabric panels of a woven first material having a warp yarn with indigo-dyed cotton yarn, and the fabric panels are sewn together using thread.

There is a digital design tool that generates at least a first laser file including a finishing pattern. The digital design tool generates a photorealistic visualization of a finishing pattern of a garment after postlaser wash on a computer screen and allows editing of the finishing pattern. The editing permitted by the digital design tool includes selecting a first combination of a garment template and a first wear pattern, and saving the first combination as the first finishing pattern. A photorealistic visualization of the first combination includes displaying on a computer screen the garment template and the first wear pattern as a garment of a first combination would appear after postlaser wash.

The editing permitted by the digital design tool includes selecting a second combination of the garment template, a first wear pattern, and a first tint color, and saving the second combination as a second finishing pattern. A photorealistic visualization of the second combination includes displaying on a computer screen the garment template and the first wear pattern along with the first tint color as a garment of the second combination would appear after postlaser wash.

A laser finishing machine receives as input at least a portion of a finishing pattern that is generated by the digital design tool. When the garment template, after being treated with at least one of ascorbic acid or sodium ascorbate as an anti-ozone treatment, is used as a target garment for a laser head of the laser finishing machine and the first finishing pattern from the digital design tool controls operation of the laser head, the laser finishing machine burns a wear pattern from the first finishing pattern on the target garment, which after the laser finishing machine burn and then a wash results in the target garment becoming a first garment product.

When the garment template, after being treated with at least one of ascorbic acid or sodium ascorbate as an anti-ozone treatment, is used as a target garment for a laser head of the laser finishing machine and the second finishing pattern from the digital design tool controls operation of the laser head, the laser finishing machine burns a wear pattern from the first finishing pattern on the target garment, which after the laser finishing machine burn and then a wash with a tint color, corresponding the first tint color selected via the digital design tool, results in the target garment becoming a second garment product.

The first garment product is identifiable by a first product code identifier. The second garment product is identifiable by a second product code identifier. The second product code identifier is different from the first product code identifier, and the second garment product has a tint color that distinguishes an appearance of the second garment product from the first garment product.

In various implementations, the digital design tool can generate a three-dimensional photorealistic visualization. For example, the three-dimensional photorealistic visualization of the first combination can include displaying on a computer screen a three-dimensional rendering of the garment template and the first wear pattern as a garment of a first combination would appear after postlaser wash. The three-dimensional photorealistic visualization of the first combination can include displaying on a computer screen a three-dimensional rendering the garment template and the first wear pattern along with the first tint color as a garment of the second combination would appear after postlaser wash.

In an implementation, a system includes a garment template that has been treated with at least one of ascorbic acid or sodium ascorbate as an anti-ozone treatment. The garment template is an assembled garment made from fabric panels of a woven first material having a warp yarn with indigo-dyed cotton yarn, and the fabric panels are sewn together using thread.

There is a digital design tool that generates at least a first laser file including a finishing pattern. The digital design tool generates a photorealistic visualization of a finishing pattern of a garment after postlaser wash on a computer screen and allows editing of the finishing pattern. The editing permitted by the digital design tool includes selecting a first combination of a garment template and a first wear pattern, and saving the first combination as the first finishing pattern. A photorealistic visualization of the first combination includes displaying on a computer screen the garment template and the first wear pattern as a garment of a first combination would appear after postlaser wash.

The editing permitted by the digital design tool includes selecting a second combination of the garment template, a first wear pattern, and at least one damage asset, and saving the second combination as a second finishing pattern. A photorealistic visualization of the second combination includes displaying on a computer screen the garment template and the first wear pattern along with the at least one damage asset as a garment of the second combination would appear after postlaser wash, and the at least one damage asset has a shredded appearance in the photorealistic visualization of the third combination.

A laser finishing machine receives as input at least a portion of a finishing pattern that is generated by the digital design tool. When the garment template, after being treated with at least one of ascorbic acid or sodium ascorbate as an anti-ozone treatment, is used as a target garment for a laser head of the laser finishing machine and the first finishing pattern from the digital design tool controls operation of the laser head, the laser finishing machine burns a wear pattern from the first finishing pattern on the target garment, which after the laser finishing machine burn and then a wash results in the target garment becoming a first garment product.

When the garment template, after being treated with at least one of ascorbic acid or sodium ascorbate as an anti-ozone treatment, is used as a target garment for a laser head of the laser finishing machine and the second finishing pattern from the digital design tool controls operation of the laser head, the laser finishing machine burns a wear pattern from the first finishing pattern and the at least one damage asset on the target garment, which after the laser finishing machine burn and then a wash results in the target garment becoming a second garment product.

The first garment product is identifiable by a first product code identifier. The second garment product is identifiable by a second product code identifier. The second product code identifier is different from the first product code identifier, and the second garment product includes the at least one damage asset that distinguishes an appearance of the second garment product from the first garment product.

In various implementations, the digital design tool generates a three-dimensional photorealistic visualization. For example, the three-dimensional photorealistic visualization of the first combination can include displaying on a computer screen a three-dimensional rendering of the garment template and the first wear pattern as a garment of a first combination would appear after postlaser wash. The three-dimensional photorealistic visualization of the first combination can include displaying on a computer screen a three-dimensional rendering of the garment template and the first wear pattern along with the at least one damage asset as a garment of the second combination would appear after postlaser wash, and the at least one damage asset has a shredded appearance in the photorealistic visualization of the third combination.

In an implementation, a system includes a garment template that has been treated with with an antioxidant constituent as an anti-ozone treatment. The garment template is an assembled garment made from fabric panels of a woven first material having a warp yarn with indigo-dyed cotton yarn, and the fabric panels are sewn together using thread.

There is a digital design tool that generates at least a first laser file including a finishing pattern. The digital design tool generates a photorealistic visualization of a finishing pattern of a garment after postlaser wash on a computer screen and allows editing of the finishing pattern. The editing permitted by the digital design tool includes selecting a first combination of a garment template and a first wear pattern, and saving the first combination as the first finishing pattern. A photorealistic visualization of the first combination includes displaying on a computer screen the garment template and the first wear pattern as a garment of a first combination would appear after postlaser wash.

A laser finishing machine receives as input at least a portion of a finishing pattern that is generated by the digital design tool. When a garment template, after being treated with with an antioxidant constituent, is used as a target garment for a laser head of the laser finishing machine and the first finishing pattern from the digital design tool controls operation of the laser head, the laser finishing machine burns a wear pattern from the first finishing pattern on the target garment, which after the laser finishing machine burn and then a wash results in the target garment becoming a first garment product. The first garment product is identifiable by a first product code identifier.

The antioxidant constituent can include ascorbic acid or sodium ascorbate. The antioxidant constituent can include sodium bisulfate or ethylene diamine.

In an implementation, a method includes: creating a garment template including assembling fabric panels of a woven first material into an assembled garment, where the first material having a warp yarn with indigo-dyed cotton yarn, and the fabric panels are sewn together using thread, washing the assembled garment in about 1.5 to about 2.5 grams per liter of ascorbic acid, and drying the washed assembled garment; storing the dried washed assembled garment as the garment template in an template inventory; and using a laser machine to form a finishing pattern on the garment template by laser, where the laser machine marks a surface of the garment pattern a pattern according to a digital file input to the laser machine.

In an implementation, a method includes creating a garment template including assembling fabric panels of a woven first material into an assembled garment, where the first material having a warp yarn with indigo-dyed cotton yarn, and the fabric panels are sewn together using thread, washing the assembled garment in anti-ozone agent, and drying the washed assembled garment; storing the dried washed assembled garment as the garment template in an template inventory, where the anti-ozone agent prevents yellowing due to exposure to ozone; and using a laser machine to form a finishing pattern on the garment template by laser, where the laser machine marks a surface of the garment pattern a pattern according to a digital file input to the laser machine.

In various implementations, the garment template can include at least one of before the washing the assembled garment, washing the assembled garment in a solution including water, enzyme, and pumice stone; before the washing the assembled garment, washing the assembled garment in a solution including water and bleach; or before the washing the assembled garment, washing the assembled garment in a solution including water and a tint dye, or any combination of these. The washing the assembled garment can include ascorbic acid and a softener.

The garment template can be stored in a template inventory at a first facility, which also houses the laser machine. The washing of the assembled garment and the drying the washed assembled garment can be performed at a first facility, and the garment template is stored in a template inventory at a second facility, which also houses the laser machine. The first facility and second facility are at different geographic locations.

The method can include using a digital design tool to generate the digital file input for the laser machine, where the digital design tool generates a photorealistic visualization of a finishing pattern of a garment after a postlaser wash on a computer screen and allows editing of the finishing pattern, and the digital design tool executes on a design computer that is separate from the laser machine. The design computer can be a tablet computer having a touch screen display. The photorealistic visualization can include a three-dimensional rendering.

Other objects, features, and advantages of the present invention will become apparent upon consideration of the following detailed description and the accompanying drawings, in which like reference designations represent like features throughout the figures.

BRIEF DESCRIPTION OF THE DRAWINGS

FIGS. 11-14 show how the laser alters the color of ring-dyed yarn.

DETAILED DESCRIPTION OF THE INVENTION

Figure 1:
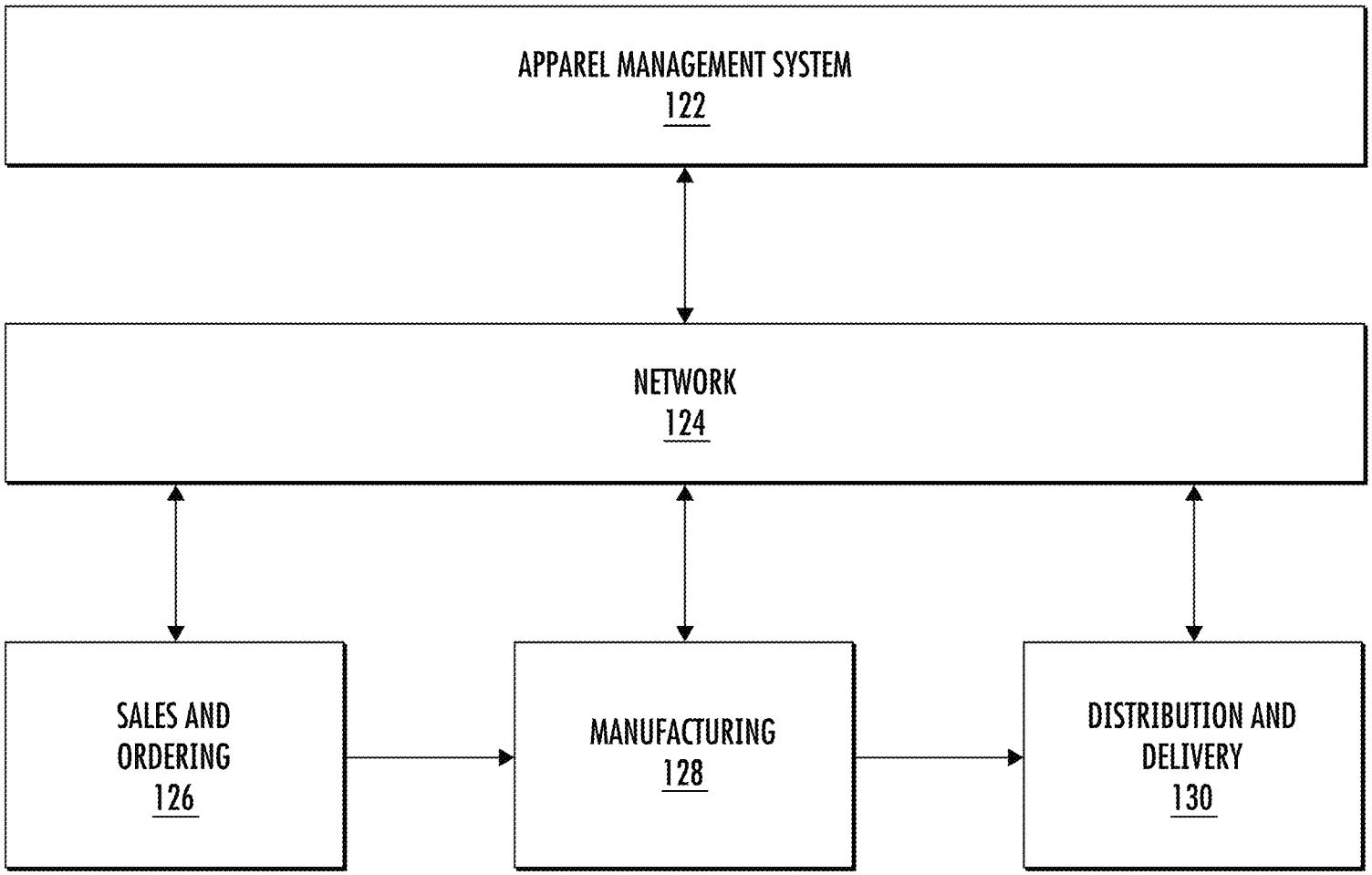
FIG. 1 shows a system for apparel manufacturing and sales.

FIG. 1 shows a system for apparel manufacturing and sales, where the apparel can include garments that have been finished using laser finishing. There is an apparel management system 122, which controls operation of the system. The apparel management system is connected by a network 124 to components of the system, including sales and ordering 126, manufacturing 128, and distribution and delivery 130 components. The network can be a computer network, such as the Internet.

Using the sales and order component, a customer can preview and selects garments to order. The customer can be a buyer for a retail store, internal buyer for retail sales of a region, regional salesperson, or other customer. The sales process can include using a variety of tools to assist a customer with showing available products, selecting products to purchase, keeping an order within budget, accessing a history of previous orders, and customizing and selecting fits, styles, and sizes of products. As an example, the customer can view products and order via a digital showroom. The products are shown digitally, which reduces the amount of physical samples that need to be produced. Further, the customer can also order via a Web site managed by the apparel management system. After the customer completes the order, the order is sent via the network (e.g., Internet) to the apparel management system.

The apparel management system sends the order to the manufacturing component, where the order is made. Manufacturing can include cutting the fabric material, assembling or sewing together the cut panels, and finishing the apparel item using a laser. An apparel manufacturer can have numerous manufacturing centers, and the apparel management system will send the order to a manufacturing center that is appropriate for the customer and order. The determination is based on a location of the customer (e.g., shipping time to customer from manufacturing center) and the apparel item selected (e.g., availability of material). The system ensures the order will be fulfilled efficiently in short amount of time.

In an implementation, the laser finishing is done after the garment is assembled. Specifically, the material is cut, assembled into a garment, and then the garment is finished using a laser. The finishing is based on style or customization selected by the customer in the order.

In another implementation, the laser finishing is before the garment is assembled. Specifically, before the material is cut, fabric rolls or sheets of material are finished using the laser. The finishing is based on style or customization selected by the customer in the order. Then the material is cut into panels, and the panels are assembled into the garment.

After manufacture of the garments of the order is complete, the apparel management system controls distribution, shipping, and delivering of the ordered garments to the customer. The apparel management system can send the customer tracking information for the order so that the customer can track the order.

Depending on various factors which may delay manufacture of some items, an order with multiple items may be sent to the customer in multiple partial shipments rather than a single complete shipment. The items not shipped at the same time will be shipped later when available. The apparel management system handles communicating with the customer regarding delays and provides an estimate of when the customer can expect to receive the items of the order.

Figure 2:
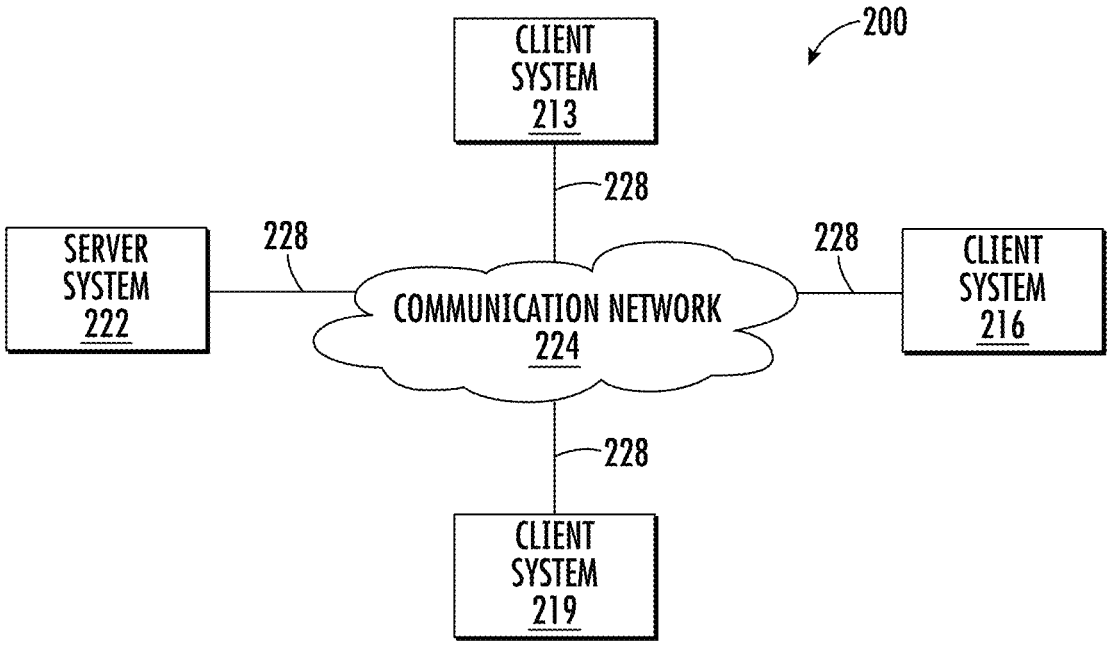
FIG. 2 shows a distributed computer network.

A system for manufacturing and sales of apparel can include one or more computers to control or monitor operation, or both. FIG. 2 shows an example of a computer that is part of, for example, the apparel management system, order component, manufacture component, delivery component, or laser finishing system, or any combination of these. The computer may be a separate unit that is connected to a system, or may be embedded in electronics of the system. In an embodiment, the system includes software that executes on a computer workstation system or server, such as shown in FIG. 2.

A system incorporating laser finishing can include a computer to control or monitor operation, or both. FIG. 2 shows an example of a computer that is component of a laser finishing system. The computer may be a separate unit that is connected to a system, or may be embedded in electronics of the system. In an embodiment, the invention includes software that executes on a computer workstation system or server, such as shown in FIG. 2.

FIG. 2 is a simplified block diagram of a distributed computer network 200 incorporating an embodiment of the present invention. Computer network 200 includes a number of client systems 213, 216, and 219, and a server system 222 coupled to a communication network 224 via a plurality of communication links 228. Communication network 224 provides a mechanism for allowing the various components of distributed network 200 to communicate and exchange information with each other.

Communication network 224 may itself be comprised of many interconnected computer systems and communication links. Communication links 228 may be hardwire links, optical links, satellite or other wireless communications links, wave propagation links, or any other mechanisms for communication of information. Communication links 228 may be DSL, Cable, Ethernet or other hardwire links, passive or active optical links, 3G, 3.5G, 4G and other mobility, satellite or other wireless communications links, wave propagation links, or any other mechanisms for communication of information.

Various communication protocols may be used to facilitate communication between the various systems shown in FIG. 2. These communication protocols may include VLAN, MPLS, TCP/IP, Tunneling, HTTP protocols, wireless application protocol (WAP), vendor-specific protocols, customized protocols, and others. While in one embodiment, communication network 1024 is the Internet, in other embodiments, communication network 1024 may be any suitable communication network including a local area network (LAN), a wide area network (WAN), a wireless network, an intranet, a private network, a public network, a switched network, and combinations of these, and the like.

Distributed computer network 200 in FIG. 2 is merely illustrative of an embodiment incorporating the present invention and does not limit the scope of the invention as recited in the claims. One of ordinary skill in the art would recognize other variations, modifications, and alternatives. For example, more than one server system 222 may be connected to communication network 224. As another example, a number of client systems 213, 216, and 219 may be coupled to communication network 224 via an access provider (not shown) or via some other server system.

Client systems 213, 216, and 219 typically request information from a server system which provides the information. For this reason, server systems typically have more computing and storage capacity than client systems. However, a particular computer system may act as both as a client or a server depending on whether the computer system is requesting or providing information. Additionally, although aspects of the invention have been described using a client-server environment, it should be apparent that the invention may also be embodied in a stand-alone computer system.

Server 222 is responsible for receiving information requests from client systems 213, 216, and 219, performing processing required to satisfy the requests, and for forwarding the results corresponding to the requests back to the requesting client system. The processing required to satisfy the request may be performed by server system 222 or may alternatively be delegated to other servers connected to communication network 224.

Client systems 213, 216, and 219 enable users to access and query information stored by server system 222. In a specific embodiment, the client systems can run as a stand-alone application such as a desktop application or mobile smartphone or tablet application. In another embodiment, a "Web browser" application executing on a client system enables users to select, access, retrieve, or query information stored by server system 222. Examples of Web browsers include the Internet Explorer browser program provided by Microsoft Corporation, Firefox browser provided by Mozilla, Chrome browser provided by Google, Safari browser provided by Apple, and others.

In a client-server environment, some resources (e.g., files, music, video, or data) are stored at the client while others are stored or delivered from elsewhere in the network, such as a server, and accessible via the network (e.g., the Internet). Therefore, the user's data can be stored in the network or "cloud." For example, the user can work on documents on a client device that are stored remotely on the cloud (e.g., server). Data on the client device can be synchronized with the cloud.

Figure 3:
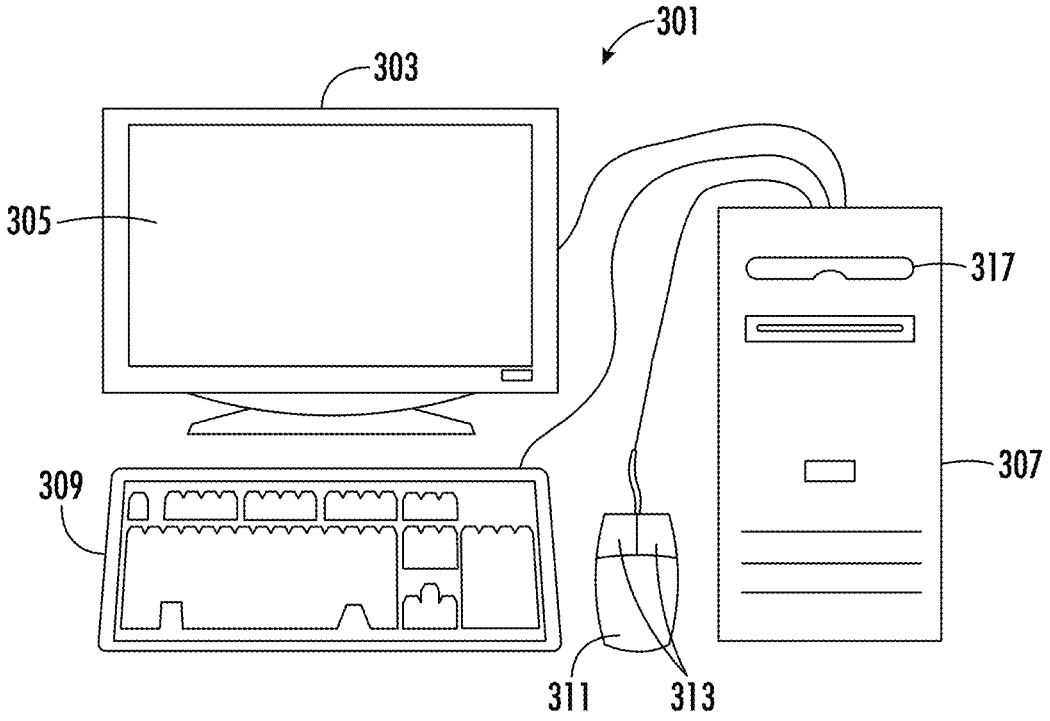
FIG. 3 shows a computer system that can be used in laser finishing.

FIG. 3 shows an exemplary client or server system of the present invention. In an embodiment, a user interfaces with the system through a computer workstation system, such as shown in FIG. 3. FIG. 3 shows a computer system 301 that includes a monitor 303, screen 305, enclosure 307 (may also be referred to as a system unit, cabinet, or case), keyboard or other human input device 309, and mouse or other pointing device 311. Mouse 311 may have one or more buttons such as mouse buttons 313.

It should be understood that the present invention is not limited any computing device in a specific form factor (e.g., desktop computer form factor), but can include all types of computing devices in various form factors. A user can interface with any computing device, including smartphones, personal computers, laptops, electronic tablet devices, global positioning system (GPS) receivers, portable media players, personal digital assistants (PDAs), other network access devices, and other processing devices capable of receiving or transmitting data.

For example, in a specific implementation, the client device can be a smartphone or tablet device, such as the Apple iPhone (e.g., Apple iPhone 6), Apple iPad (e.g., Apple iPad, Apple iPad Pro, or Apple iPad mini), Apple iPod (e.g, Apple iPod Touch), Samsung Galaxy product (e.g., Galaxy S series product or Galaxy Note series product), Google Nexus and Pixel devices (e.g., Google Nexus 6, Google Nexus 7, or Google Nexus 9), and Microsoft devices (e.g., Microsoft Surface tablet). Typically, a smartphone includes a telephony portion (and associated radios) and a computer portion, which are accessible via a touch screen display.

There is nonvolatile memory to store data of the telephone portion (e.g., contacts and phone numbers) and the computer portion (e.g., application programs including a browser, pictures, games, videos, and music). The smartphone typically includes a camera (e.g., front facing camera or rear camera, or both) for taking pictures and video. For example, a smartphone or tablet can be used to take live video that can be streamed to one or more other devices.

Enclosure 307 houses familiar computer components, some of which are not shown, such as a processor, memory, mass storage devices 317, and the like. Mass storage devices 317 may include mass disk drives, floppy disks, magnetic disks, optical disks, magneto-optical disks, fixed disks, hard disks, CD-ROMs, recordable CDs, DVDs, recordable DVDs (e.g., DVD-R, DVD+R, DVD-RW, DVD+RW, HD-DVD, or Blu-ray Disc), flash and other nonvolatile solid-state storage (e.g., USB flash drive or solid state drive (SSD)), battery-backed-up volatile memory, tape storage, reader, and other similar media, and combinations of these.

A computer-implemented or computer-executable version or computer program product of the invention may be embodied using, stored on, or associated with computer-readable medium. A computer-readable medium may include any medium that participates in providing instructions to one or more processors for execution. Such a medium may take many forms including, but not limited to, nonvolatile, volatile, and transmission media. Nonvolatile media includes, for example, flash memory, or optical or magnetic disks. Volatile media includes static or dynamic memory, such as cache memory or RAM. Transmission media includes coaxial cables, copper wire, fiber optic lines, and wires arranged in a bus. Transmission media can also take the form of electromagnetic, radio frequency, acoustic, or light waves, such as those generated during radio wave and infrared data communications.

For example, a binary, machine-executable version, of the software of the present invention may be stored or reside in RAM or cache memory, or on mass storage device 317. The source code of the software of the present invention may also be stored or reside on mass storage device 317 (e.g., hard disk, magnetic disk, tape, or CD-ROM). As a further example, code of the invention may be transmitted via wires, radio waves, or through a network such as the Internet.

Figure 4:
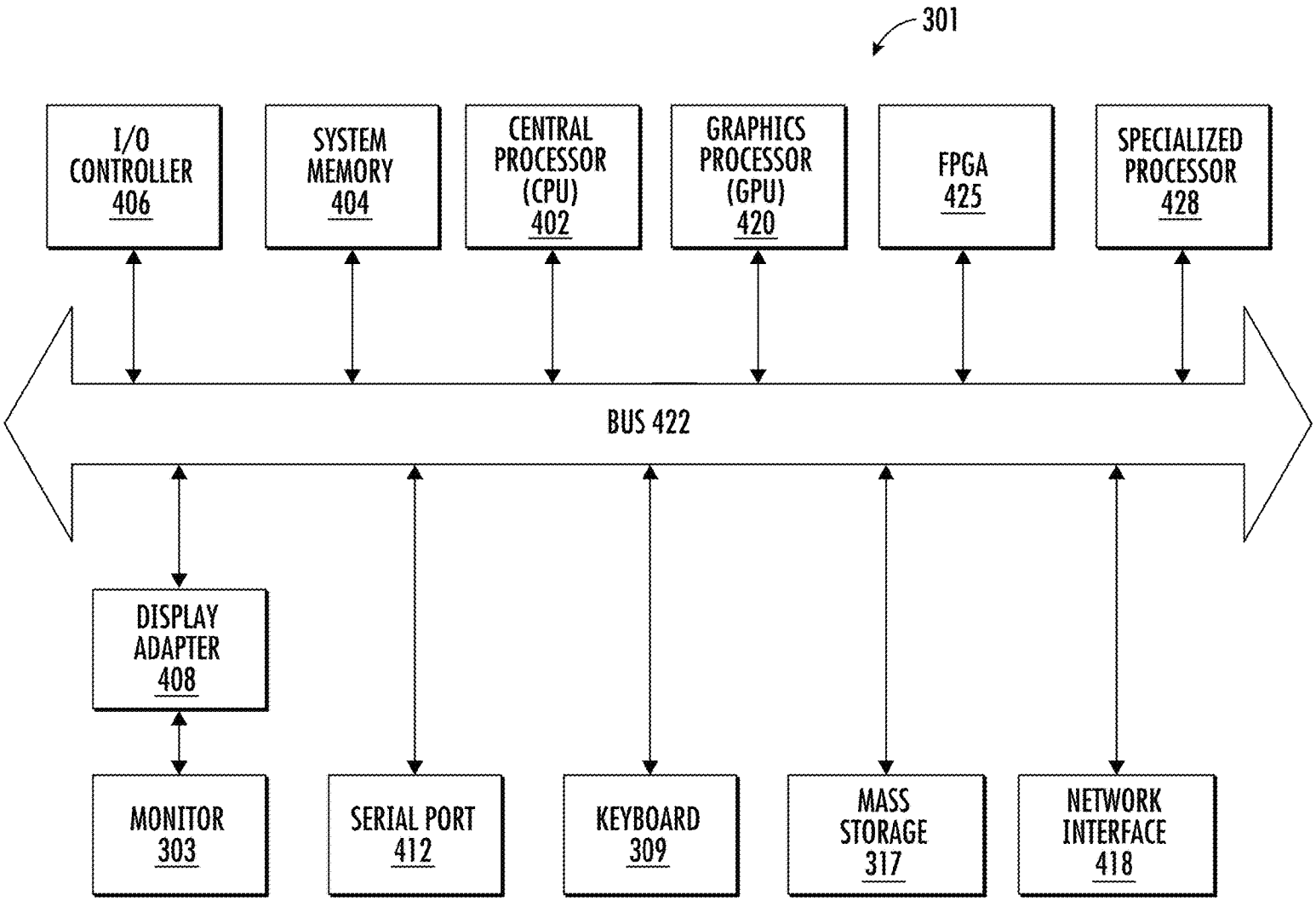
FIG. 4 shows a system block diagram of the computer system.

FIG. 4 shows a system block diagram of computer system 301 used to execute the software of the present invention. As in FIG. 3, computer system 301 includes monitor 303, keyboard 309, and mass storage devices 317. Computer system 301 further includes subsystems such as central processor (CPU) 402, system memory 404, input/output (I/O) controller 406, display adapter 408, serial or universal serial bus (USB) port 412, network interface 418, graphics processor (GPU) 420, field programmable gate array (FPGA) 425, and specialized processor 428 (e.g., ASIC, physics processor, digital signal processor (DSP), or other processor). The invention may also be used with computer systems with additional or fewer subsystems. For example, a computer system could include more than one processor 402 (i.e., a multiprocessor system) or a system may include a cache memory.

The computer system may include any number of graphics processors. The graphics processor may reside on the motherboard such as being integrated with the motherboard chipset. One or more graphics processors may reside on external boards connected to the system through a bus such as an ISA bus, PCI bus, AGP port, PCI Express, or other system buses. Graphics processors may on separate boards, each connected to a bus such as the PCI Express bus to each other and to the rest of the system. Further, there may be a separate bus or connection (e.g., Nvidia SLI or ATI Cross-Fire connection) by which the graphics processors may communicate with each other. This separate bus or connection may be used in addition to or in substitution for system bus.

The processor, CPU or GPU, or both, may be a dual core or multicore processor, where there are multiple processor cores on a single integrated circuit. The system may also be part of a distributed computing environment. In a distributed computing environment, individual computing systems are connected to a network and are available to lend computing resources to another system in the network as needed. The network may be an internal Ethernet network, Internet, or other network. Multiple processors (e.g., CPU, GPU, FPGA, and other specialized processors, in any combination) can be utilized on multiple, different machines connected by the network. These machines that perform the computation in parallel may connected through the Internet (or Cloud) using a paradigm known as Cloud computing.

Arrows such as 422 represent the system bus architecture of computer system 301. However, these arrows are illustrative of any interconnection scheme serving to link the subsystems. For example, GPU 420 could be connected to the other subsystems through a port or have an internal direct connection to central processor 402. The processor may include multiple processors or a multicore processor, which may permit parallel processing of information. Computer system 301 shown in FIG. 4 is but an example of a computer system suitable for use with the present invention. Other configurations of subsystems suitable for use with the present invention will be readily apparent to one of ordinary skill in the art.

Computer software products may be written in any of various suitable programming languages, such as C, C++, C #, Pascal, Fortran, Perl, Matlab (from MathWorks, www-.mathworks.com), SAS, SPSS, JavaScript, AJAX, Java, Python, Erlang, and Ruby on Rails. The computer software product may be an independent application with data input and data display modules. Alternatively, the computer software products may be classes that may be instantiated as distributed objects. The computer software products may also be component software such as Java Beans (from Oracle Corporation) or Enterprise Java Beans (EJB from Oracle Corporation).

An operating system for the system may be one of the Microsoft Windows® family of systems (e.g., Windows 95, 98, Me, Windows NT, Windows 2000, Windows XP, Windows XP x64 Edition, Windows Vista, Windows 7, Windows 8, Windows 10, Windows CE, Windows Mobile, Windows RT), Symbian OS, Tizen, Linux, HP-UX, UNIX, Sun OS, Solaris, Mac OS X, Apple iOS, Android, Alpha OS, AIX, IRIX32, or IRIX64. Other operating systems may be used. Microsoft Windows is a trademark of Microsoft Corporation.

Any trademarks or service marks used in this patent are property of their respective owner. Any company, product, or service names in this patent are for identification purposes only. Use of these names, logos, and brands does not imply endorsement.

Furthermore, the computer may be connected to a network and may interface to other computers using this network. The network may be an intranet, internet, or the Internet, among others. The network may be a wired network (e.g., using copper), telephone network, packet network, an optical network (e.g., using optical fiber), or a wireless network, or any combination of these. For example, data and other information may be passed between the computer and components (or steps) of a system of the invention using a wireless network using a protocol such as Wi-Fi (IEEE standards 802.11, 802.11a, 802.11b, 802.11e, 802.11g, 802.11i, 802.11n, 802.11ac, and 802.11ad, just to name a few examples), near field communication (NFC), radio-frequency identification (RFID), mobile or cellular wireless (e.g., 2G, 3G, 4G, 3GPP LTE, WiMAX, LTE, LTE Advanced, Flash-OFDM, HIPERMAN, iBurst, EDGE Evolution, UMTS, UMTS-TDD, 1xRDD, and EV-DO). For example, signals from a computer may be transferred, at least in part, wirelessly to components or other computers.

In an embodiment, with a Web browser executing on a computer workstation system, a user accesses a system on the World Wide Web (WWW) through a network such as the Internet. The Web browser is used to download Web pages or other content in various formats including HTML, XML, text, PDF, and postscript, and may be used to upload information to other parts of the system. The Web browser may use uniform resource identifiers (URLs) to identify resources on the Web and hypertext transfer protocol (HTTP) in transferring files on the Web.

In other implementations, the user accesses the system through either or both of native and nonnative applications. Native applications are locally installed on the particular computing system and are specific to the operating system or one or more hardware devices of that computing system, or a combination of these. These applications (which are sometimes also referred to as "apps") can be updated (e.g., periodically) via a direct internet upgrade patching mechanism or through an applications store (e.g., Apple iTunes and App store, Google Play store, Windows Phone store, and Blackberry App World store).

The system can run in platform-independent, nonnative applications. For example, client can access the system through a Web application from one or more servers using a network connection with the server or servers and load the Web application in a Web browser. For example, a Web application can be downloaded from an application server over the Internet by a Web browser. Nonnative applications can also be obtained from other sources, such as a disk.

Machine learning is used in apparel design to create realistic patterns and designs (e.g., wear pattern) on apparel. A realistic appearing pattern refers to a pattern that a person would not be able to (or would be difficult to) discriminate as being a fake (e.g., generated or manufactured artificially by a computer).

Machine learning is a field of computer science, and in particular, artificial intelligence (AI), that gives computers the ability to automatically learn and improve from experience without being explicitly programmed. Machine learning can utilize an artificial neural network (or simply, a neural net) that is based on a collection of connected units called artificial neurons.

Machine learning algorithms can be categorized as supervised or unsupervised. Supervised machine learning algorithms can apply what has been learned in the past to new data using labeled examples to predict future events. Starting from the analysis of a known training dataset, the learning algorithm produces an inferred function to make predictions about the output values. The system is able to provide targets for any new input after sufficient training. The learning algorithm can also compare its output with the correct, intended output and find errors in order to modify the model accordingly.

Unsupervised machine learning algorithms are used when the information used to train is neither classified nor labeled. Unsupervised learning studies how systems can infer a function to describe a hidden structure from unlabeled data. The system does not figure out the right output, but it explores the data and can draw inferences from datasets to describe hidden structures from unlabeled data.

In an implementation, machine learning and artificial neural network computations for apparel design are executed on a hardware or software system, or combination, comprising one or more specialized processing units. Examples of the specialized processing units include central processing units (CPUs), graphical processing units (GPUs), physics processors, cell processors, digital signal processors (DSPs), field programmable gate arrays (FPGAs), application specific integrated circuits (ASICs), and the like. Portions of the neural computational task for apparel design may be transformed into the form of mathematical manipulations. GPUs may be particularly well suited to performing such operations.

In this application, GPUs are used as an example of a specialized processor, but this is not intended to limit the scope of the teaching of this patent to GPUs. A neural net may utilize any of the specialized processors mentioned previously, and other substantially similar processors as understood by those having ordinary skills in the art and as similar or related processors may be developed later. An interface facilitating a neural net may be at least one of a PCI Express bus, AGP bus, front side bus, Ethernet, the Internet, or other interface that facilitates the transfer of data in any form including serial or parallel.

An alternative hardware configuration includes a cooperative collection of specialized processing units where each processing unit may be well suited for a specific type of computation. This hardware configuration will be defined here as a "heterogeneous configuration" meaning that the various computational tasks are executed by different, typically specialized, processors. As an example, GPUs are designed specifically for high throughput on specialized types of problems found in graphics processing that require a large number of arithmetic calculations with a relatively small number of memory access steps. Other specialized processors may be designed to handle other types of data or computational problems. Allocating the various portions of the neural net computations to specialized processors may improve the throughput, increase the efficiency, lower the cost, and improve the results of the computation.

GPUs may be designed for fast graphics processing. The data may be organized into a stream where a stream is an ordered set of data of the same data type. Operations, procedures, methods, algorithms, and the like that may be applied to entire streams of data are typically called kernels. Kernels are very efficient because they depend only on their input. Internal computations within the kernel are independent of other elements of the stream. Therefore, GPUs may be designed for parallel processing, memory efficiency, and high throughput for specific problems.

GPUs typically have hardware blocks that may be specifically designed for certain types of problems (e.g., specific kernels may be implemented in hardware). As an example, hardware blocks may be designed to implement various types of vector or matrix computations, or both. As an example, graphics data is typically four-dimensional referring to the channel value of the red, green, and blue pixels (referred to as RGB) and the opacity value (typically referred as alpha or A). Therefore, GPUs have been designed to process images (e.g., four-dimensional (RGBA) data) very quickly and very efficiently.

Figure 5:
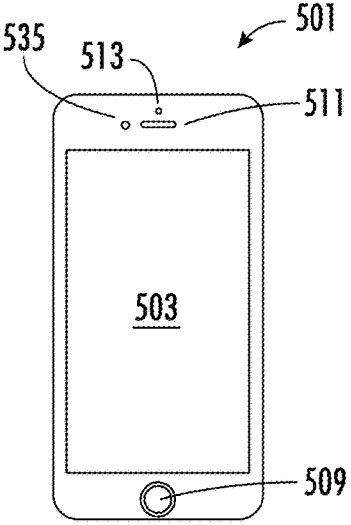
FIGS. 5-6 show examples of mobile devices.
Figure 6:
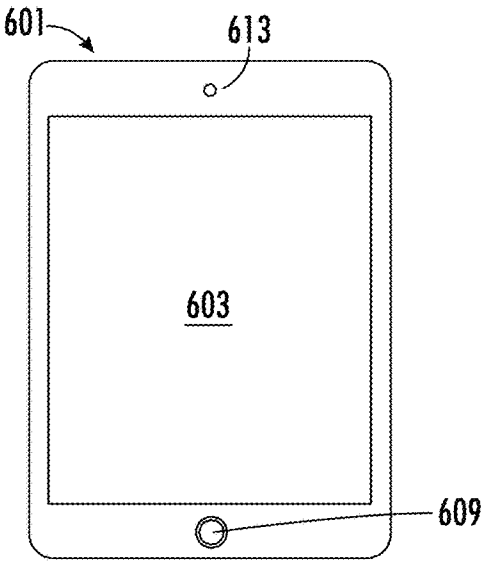

FIGS. 5-6 show examples of mobile devices, which can be mobile clients. Mobile devices are specific implementations of a computer, such as described above. FIG. 5 shows a smartphone device 501, and FIG. 6 shows a tablet device 601. Some examples of smartphones include the Apple iPhone, Samsung Galaxy, and Google Nexus family of devices. Some examples of tablet devices include the Apple iPad, Apple iPad Pro, Samsung Galaxy Tab, and Google Nexus family of devices.

Smartphone 501 has an enclosure that includes a screen 503, button 509, speaker 511, camera 513, and proximity sensor 535. The screen can be a touch screen that detects and accepts input from finger touch or a stylus. The technology of the touch screen can be a resistive, capacitive, infrared grid, optical imaging, or pressure-sensitive, dispersive signal, acoustic pulse recognition, or others. The touch screen is screen and a user input device interface that acts as a mouse and keyboard of a computer.

Button 509 is sometimes referred to as a home button and is used to exit a program and return the user to the home screen. The phone may also include other buttons (not shown) such as volume buttons and on-off button on a side. The proximity detector can detect a user's face is close to the phone, and can disable the phone screen and its touch sensor, so that there will be no false inputs from the user's face being next to screen when talking.

Tablet 601 is similar to a smartphone. Tablet 601 has an enclosure that includes a screen 603, button 609, and camera 613. Typically the screen (e.g., touch screen) of a tablet is larger than a smartphone, usually 7, 8, 9, 10, 12, 13, or more inches (measured diagonally).

Figure 7:
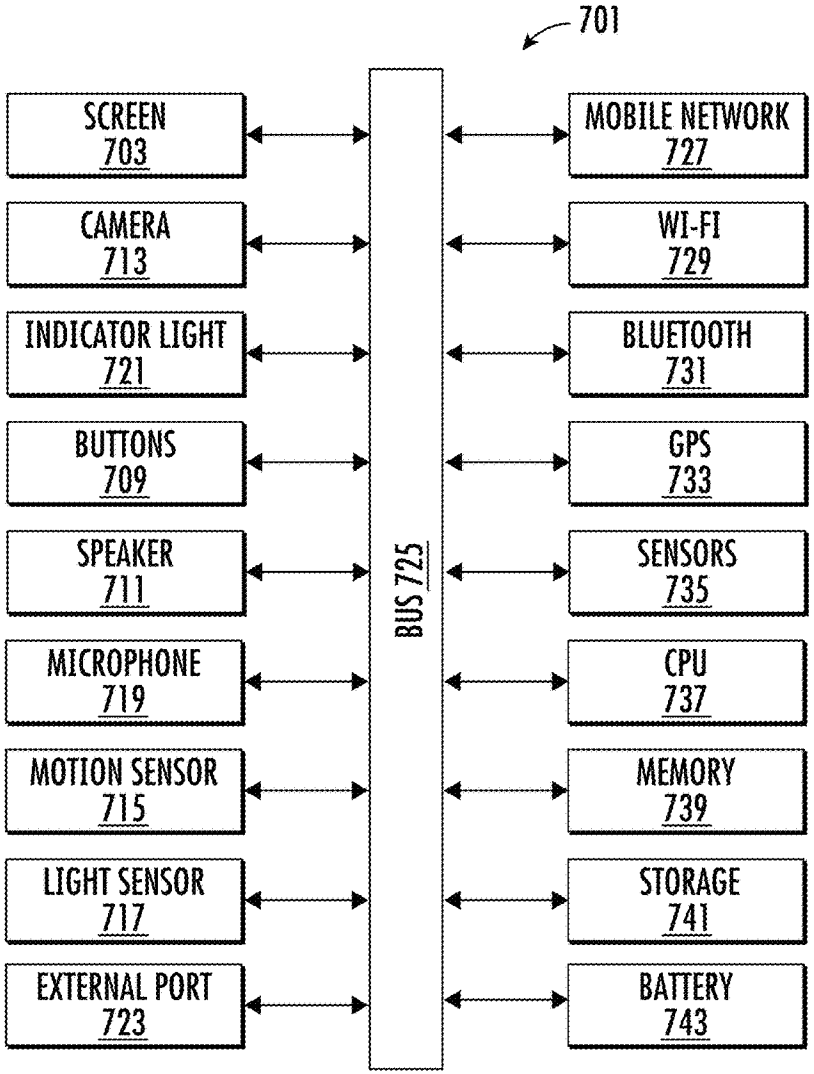
FIG. 7 shows a system block diagram of a mobile device.

FIG. 7 shows a system block diagram of mobile device 701 used to execute the software of the present invention. This block diagram is representative of the components of smartphone or tablet device. The mobile device system includes a screen 703 (e.g., touch screen), buttons 709, speaker 711, camera 713, motion sensor 715, light sensor 717, microphone 719, indicator light 721, and external port 723 (e.g., USB port or Apple Lightning port). These components can communicate with each other via a bus 725.

The system includes wireless components such as a mobile network connection 727 (e.g., mobile telephone or mobile data), Wi-Fi 729, Bluetooth 731, GPS 733 (e.g., detect GPS positioning), other sensors 735 such as a proximity sensor, CPU 737, RAM memory 739, storage 741 (e.g., nonvolatile memory), and battery 743 (lithium ion or lithium polymer cell). The battery supplies power to the electronic components and is rechargeable, which allows the system to be mobile.

Figure 8:
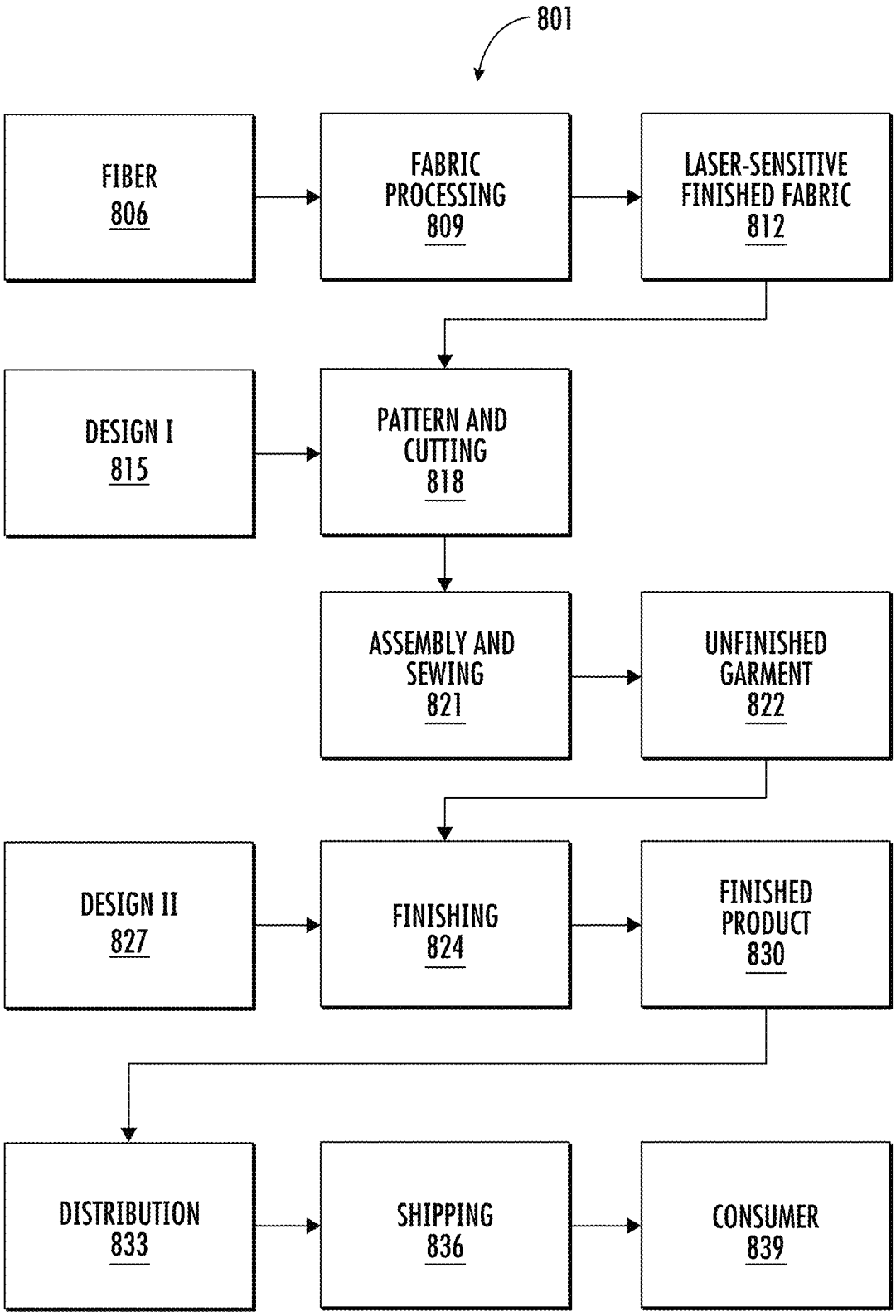
FIG. 8 shows a block diagram of a system for creating, designing, producing apparel products with laser finishing.

FIG. 8 shows a process flow 801 for manufacturing apparel such as jeans, where garments are finished using a laser. The fabric or material for various apparel including jeans is made from natural or synthetic fibers 806, or a combination of these. A fabric mill takes fibers and processes 809 these fibers to produce a laser-sensitive finished fabric 812, which has enhanced response characteristics for laser finishing.

Some examples of natural fibers include cotton, flax, hemp, sisal, jute, kenaf, and coconut; fibers from animal sources include silk, wool, cashmere, and mohair. Some examples of synthetic fibers include polyester, nylon, spandex or elastane, and other polymers. Some examples of semisynthetic fibers include rayon, viscose, modal, and lyocell, which are made from a regenerated cellulose fiber. A fabric can be a natural fiber alone (e.g., cotton), a synthetic fiber alone (e.g., polyester alone), a blend of natural and synthetic fibers (e.g., cotton and polyester blend, or cotton and spandex), or a blend of natural and semisynthetic fibers, or any combination of these or other fibers.

For jeans, the fabric is typically a denim, which is a sturdy cotton warp-faced textile in which a weft passes under two or more warp threads. This twill weaving produces a diagonal ribbing. The yarns (e.g., warp yarns) are dyed using an indigo or blue dye, which is characteristic of blue jeans.

Although this patent describes the apparel processing and finishing with respect to jeans, the invention is not limited jeans or denim products, such as shirts, shorts, jackets, vests, and skirts. The techniques and approaches described are applicable to other apparel and products, including non-denim products and products made from knit materials. Some examples include T-shirts, sweaters, coats, sweatshirts (e.g., hoodies), casual wear, athletic wear, outerwear, dresses, evening wear, sleepwear, loungewear, underwear, socks, bags, backpacks, uniforms, umbrellas, swimwear, bed sheets, scarves, and many others.

A manufacturer creates a design 815 (design I) of its product. The design can be for a particular type of clothing or garment (e.g., men's or women's jean, or jacket), sizing of the garment (e.g., small, medium, or large, or waist size and inseam length), or other design feature. The design can be specified by a pattern or cut used to form pieces of the pattern. A fabric is selected and patterned and cut 818 based on the design. The pattern pieces are assembled together 821 into the garment, typically by sewing, but can be joined together using other techniques (e.g., rivets, buttons, zipper, hoop and loop, adhesives, or other techniques and structures to join fabrics and materials together).

Some garments can be complete after assembly and ready for sale. However, other garments are unfinished 822 and have additional finishing 824, which includes laser finishing. The finishing may include tinting, washing, softening, and fixing. For distressed denim products, the finishing can include using a laser to produce a wear pattern according to a design 827 (design II). Some additional details of laser finishing are described in U.S. patent application 62/377,447, filed Aug. 19, 2016, and Ser. No. 15/682,507, filed Aug. 21, 2017, are incorporated by reference along with all other references cited in this application.

Design 827 is for postassembly aspects of a garment while design 815 is for preassembly aspects of a garment. After finishing, a finished product 830 (e.g., a pair of jeans) is complete and ready for sale. The finished product is inventoried and distributed 833, delivered to stores 836, and sold to consumers or customers 839. The consumer can buy and wear worn blue jeans without having to wear out the jeans themselves, which usually takes significant time and effort.

Traditionally, to produce distressed denim products, finishing techniques include dry abrasion, wet processing, oxidation, or other techniques, or combinations of these, to accelerate wear of the material in order to produce a desired wear pattern. Dry abrasion can include sandblasting or using sandpaper. For example, some portions or localized areas of the fabric are sanded to abrade the fabric surface. Wet processing can include washing in water, washing with oxidizers (e.g., bleach, peroxide, ozone, or potassium permanganate), spraying with oxidizers, washing with abrasives (e.g., pumice, stone, or grit).

These traditional finishing approaches take time, incur expense, and impact the environment by utilizing resources and producing waste. It is desirable to reduce water and chemical usage, which can include eliminating the use chemicals and agents such as potassium permanganate and pumice. An alternative to these traditional finishing approaches is laser finishing.

Figure 9:
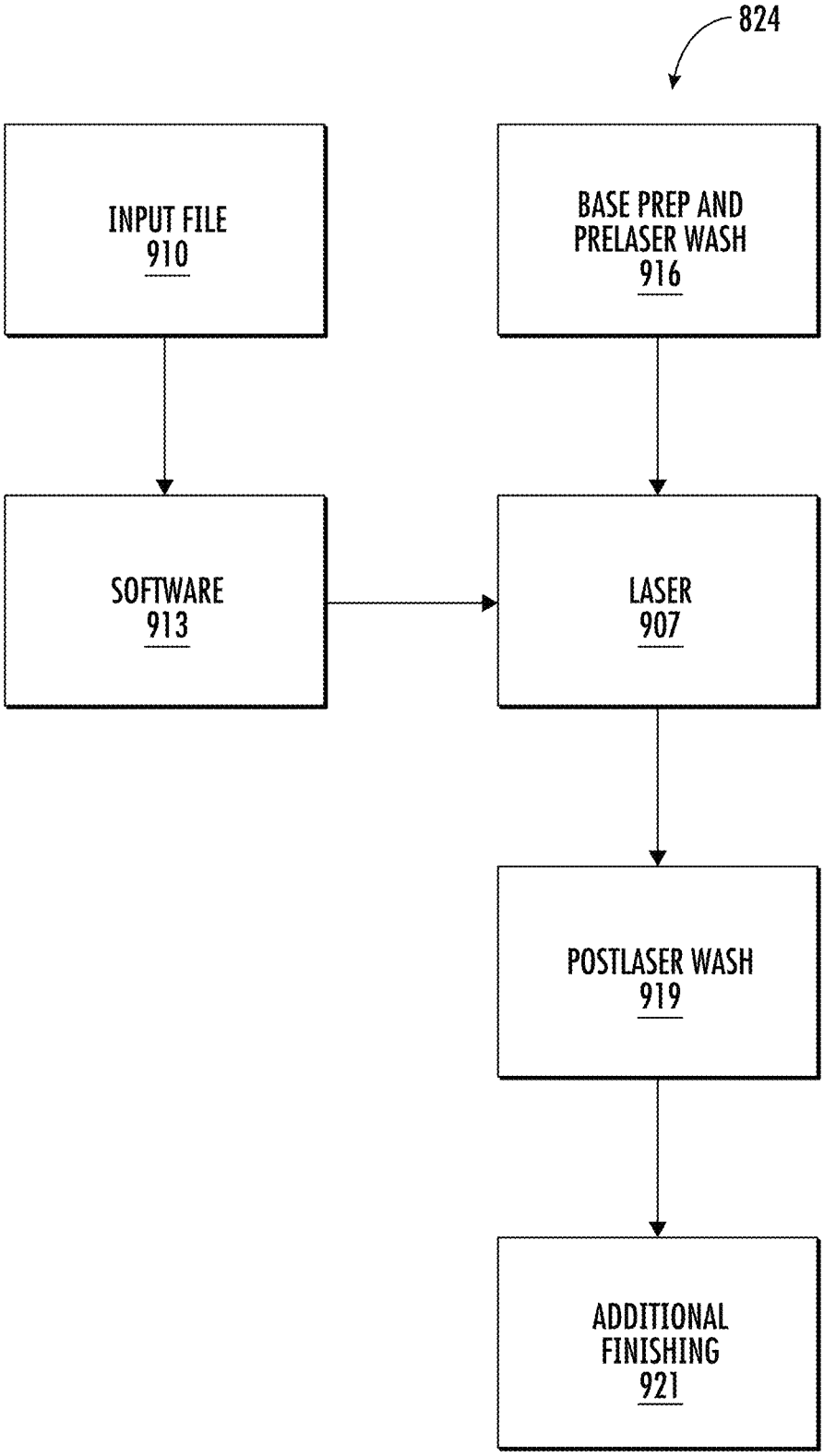
FIG. 9 shows a flow for a finishing technique that includes the use of a laser.

FIG. 9 shows a finishing technique (e.g., finishing 824) that includes the use of a laser 907. A laser is a device that emits light through a process of optical amplification based on the stimulated emission of electromagnetic radiation. Lasers are used for bar code scanning, medical procedures such as corrective eye surgery, and industrial applications such as welding. A particular type of laser for finishing apparel is a carbon dioxide laser, which emits a beam of infrared radiation.

The laser is controlled by an input file 910 and control software 913 to emit a laser beam onto fabric at a particular position or location at a specific power level for a specific amount of time. Further, the power of the laser beam can be varied according to a waveform such as a pulse wave with a particular frequency, period, pulse width, or other characteristic. Some aspects of the laser that can be controlled include the duty cycle, frequency, marking or burning speed, and other parameters.

The duty cycle is a percentage of laser emission time. Some examples of duty cycle percentages include 40, 45, 50, 55, 60, 80, and 100 percent. The frequency is the laser pulse frequency. A low frequency might be, for example, 5 kilohertz, while a high frequency might be, for example, 25 kilohertz. Generally, lower frequencies will have higher surface penetration than high frequencies, which has less surface penetration.

The laser acts like a printer and "prints," "marks," or "burns" a wear pattern (specified by input file 910) onto the garment. The fabric that is exposed to the laser beam (e.g., infrared beam) changes color, lightening the fabric at a specified position by a certain amount based on the laser power, time of exposure, and waveform used. The laser continues from position to position until the wear pattern is completely printed on the garment.

In a specific implementation, the laser has a resolution of about 34 dots per inch (dpi), which on the garment is about 0.7 millimeters per pixel. The technique described in this patent is not dependent on the laser's resolution, and will work with lasers have more or less resolution than 34 dots per inch. For example, the laser can have a resolution of 10, 15, 20, 25, 30, 40, 50, 60, 72, 80, 96, 100, 120, 150, 200, 300, or 600 dots per inch, or more or less than any of these or other values. Typically, the greater the resolution, the finer the features that can be printed on the garment in a single pass. By using multiple passes (e.g., 2, 3, 4, 5, or more passes) with the laser, the effective resolution can be increased. In an implementation, multiple laser passes are used.

Jeans are dyed using an indigo dye, which results in a blue colored fabric. The blue color is caused by chromophores trapped in the fabric which reflect light as a blue color. U.S. patent applications 62/433,739, filed Dec. 13, 2016, and Ser. No. 15/841,263, filed Dec. 13, 2017, which are incorporated by reference, describe a denim material with enhanced response characteristics to laser finishing. Using a denim material made from indigo ring-dyed yarn, variations in highs and lows in indigo color shading is achieved by using a laser.

U.S. patent applications 62/715,788, filed Aug. 7, 2018; 62/636,108, 62/636,107, and 62/636,112, filed Feb. 27, 2018; Ser. No. 15/682,507, filed Aug. 21, 2017; Ser. No. 15/841,268, filed Dec. 13, 2017; and 62/579,863 and 62/579,867, filed Oct. 31, 2017 are incorporated by reference.

Figure 10:
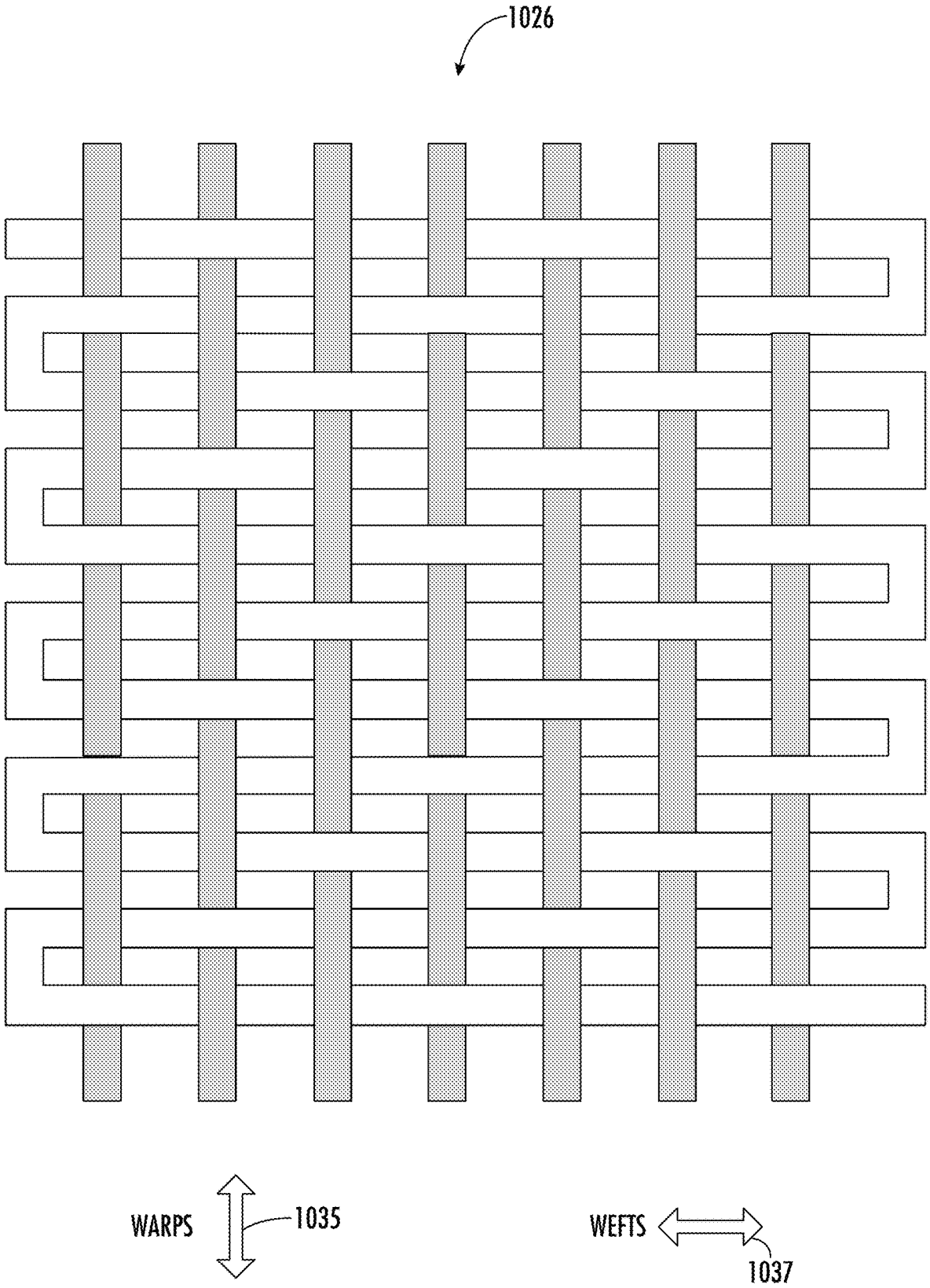
FIG. 10 shows a weave pattern for a denim fabric.

FIG. 10 shows a weave pattern of a denim fabric 1026. A loom does the weaving. In weaving, warp is the lengthwise or longitudinal yarn or thread in a roll, while weft or woof is the transverse thread. The weft yarn is drawn through the warp yarns to create the fabric. In FIG. 10, the warps extend in a first direction 1035 (e.g., north and south) while the wefts extend in a direction 1037 (e.g., east and west). The wefts are shown as a continuous yarn that zigzags across the wefts (e.g., carried across by a shuttle or a rapier of the loom). Alternatively, the wefts could be separate yarns. In some specific implementations, the warp yarn has a different weight or thickness than the weft yarns. For example, warp yarns can be coarser than the weft yarns.

For denim, dyed yarn is used for the warp, and undyed or white yarn is typically used for the weft yarn. In some denim fabrics, the weft yarn can be dyed and have a color other than white, such as red. In the denim weave, the weft passes under two or more warp threads. FIG. 13 shows a weave with the weft passing under two warp threads. Specifically, the fabric weave is known as a 2×1 right-hand twill. For a right-hand twill, a direction of the diagonal is from a lower left to an upper right. For a left-hand twill, a direction of the diagonal is from an lower right to an upper left. But in other denim weaves, the weft can pass under a different number of warp threads, such as 3, 4, 5, 6, 7, 8, or more. In other implementation, the denim is a 3×1 right-hand twill, which means the weft passes under three warp threads.

Because of the weave, one side of the fabric exposes more of the warp yarns (e.g., warp-faced side), while the other side exposes more of the weft yarns (e.g., weft-faced side). When the warp yarns are blue and weft yarns are white, a result of the weave is the warp-faced side will appear mostly blue while the reverse side, weft-faced side, will appear mostly white.

In denim, the warp is typically 100 percent cotton. But some warp yarns can be a blend with, for example, elastane to allow for warp stretch. And some yarns for other fabrics may contain other fibers, such as polyester or elastane as examples.

In an indigo ring-dyed yarn, the indigo does not fully penetrate to a core of the yarn. Rather, the indigo dye is applied at a surface of the cotton yarn and diffuses toward the interior of the yarn. So when the yarn is viewed cross-sectionally, the indigo dyed material will appear as a ring on around an outer edge of the yarn. The shading of the indigo dye will generally lighten in a gradient as a distance increases from the surface of the yarn to the center (or core) of the yarn.

During laser finishing, the laser removes a selected amount of the surface of the indigo dyed yarn (e.g., blue color) to reveal a lighter color (e.g., white color) of the inner core of the ring-dyed yarn. The more of the indigo dyed material that is removed, the lighter the color (e.g., lighter shade of blue). The more of the indigo dyed material that remains, the darker the color (e.g., deeper shade of blue).

The laser can be controlled precisely to remove a desired amount of material to achieve a desired shade of blue in a desired place or position on the material.

With laser finishing, a finish can be applied (e.g., printed or burned via the laser) onto apparel (e.g., jeans and denim garments) that will appear similar to or indistinguishable from a finish obtained using traditional processing techniques (e.g., dry abrasion, wet processing, and oxidation). Laser finishing of apparel is less costly and is faster than traditional finishing techniques and also has reduced environmental impact (e.g., eliminating the use of harsh chemical agents and reducing waste).

FIGS. 11-14 show how the laser alters the color of ring-dyed yarn. FIG. 11 shows a laser beam 1107 striking a ring-dyed yarn 1113 having indigo-dyed fibers 1118 and white core fibers 1122. The laser removes the dyed fibers, which can be by vaporizing or otherwise destroying the cotton fiber via heat or high temperature that the laser beam causes.

Although this patent describes burning of a pattern by laser, the actual chemical or physical process of the laser may include burning or oxidation, ablation, sublimation, or decomposition of the dyestuff itself or the material incorporating the dyestuff, or any combination of these. The terms printing, marking, or burning are used to refer to any of the chemical or physical processes by which the laser removes dyestuff from the material.

FIG. 12 shows the laser using a first power level setting or first exposure time setting, or a combination of these, to remove some of the dyed fibers, but not revealing any of the white core fibers. The undyed fibers remain covered. There is no color change.

FIG. 13 shows the laser using a second power level setting or second exposure time setting, or a combination of these, to remove more of the dyed fibers than in FIG. 12. The second power level is greater than the first power level, or the second exposure time setting is greater than the first exposure time setting, or a combination of these. The result is some of the undyed fibers are revealed. There is a color change, subtle highlighting.

FIG. 14 shows the laser using a third power level setting or third exposure time setting, or a combination of these, to remove even more of the dyed fibers than in FIG. 13. The third power level is greater than the second power level, or the third exposure time setting is greater than the second exposure time setting, or a combination of these. The result is more of the undyed fibers are revealed. There is a color change, brighter highlighting.

As shown in FIG. 9, before laser 907, the fabric can be prepared 916 for the laser, which may be referred to as a base preparation, and can include a prelaser wash. This step helps improves the results of the laser. After the laser, there can be a postlaser wash 919. This wash can clean or remove any residue caused by the laser, such as removing any charring (which would appear as brown or slightly burning). By the postlaser machine washing, the coloration due to the charring will be removed. There can be additional finish 921, which may be including tinting, softening, or fixing, to complete finishing.

Damage (e.g., holes, openings, or rips) can also be burned by the laser onto a garment. After lasering, the damage will appear as a whitish or yellowish region on the garment, because the laser has removed or largely removed the indigo warp yarn or its indigo-colored outer ring while leaving or mostly leaving the whitish color of the inner core or the white (or other color) weft yarn material, or both. The damage hole is not yet open and still joined together by the fine strands of yarn. However, after postlaser wash, due to the mechanical action of machine washing, the damage on the garment will open up have a shredded appearance which results from because the fine yarn strands are broken. Damage assets are discussed further in U.S. patent application Ser. No. 16/177,387, filed Oct. 31, 2018, and 62/579,863, filed Oct. 31, 2017, which are incorporated by reference.

Figure 15:
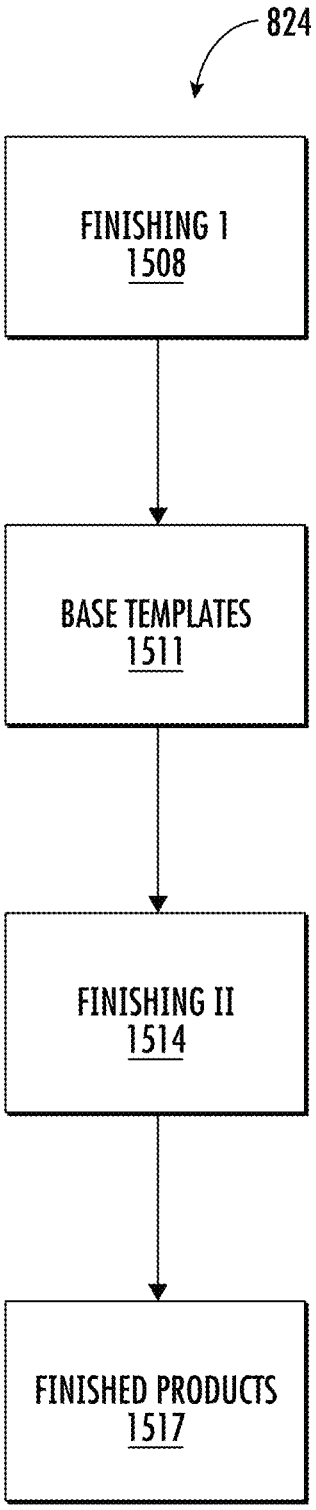
FIG. 15 shows a flow for finishing in two finishing steps and using base templates.

FIG. 15 shows a technique where finishing 824 is divided into two finishing steps, finishing I and finishing II. Finishing I 1508 is an initial finishing to create base templates 1511. With finishing II 1514, each base template can be used to manufacture multiple final finishes 1517.

Figure 16:
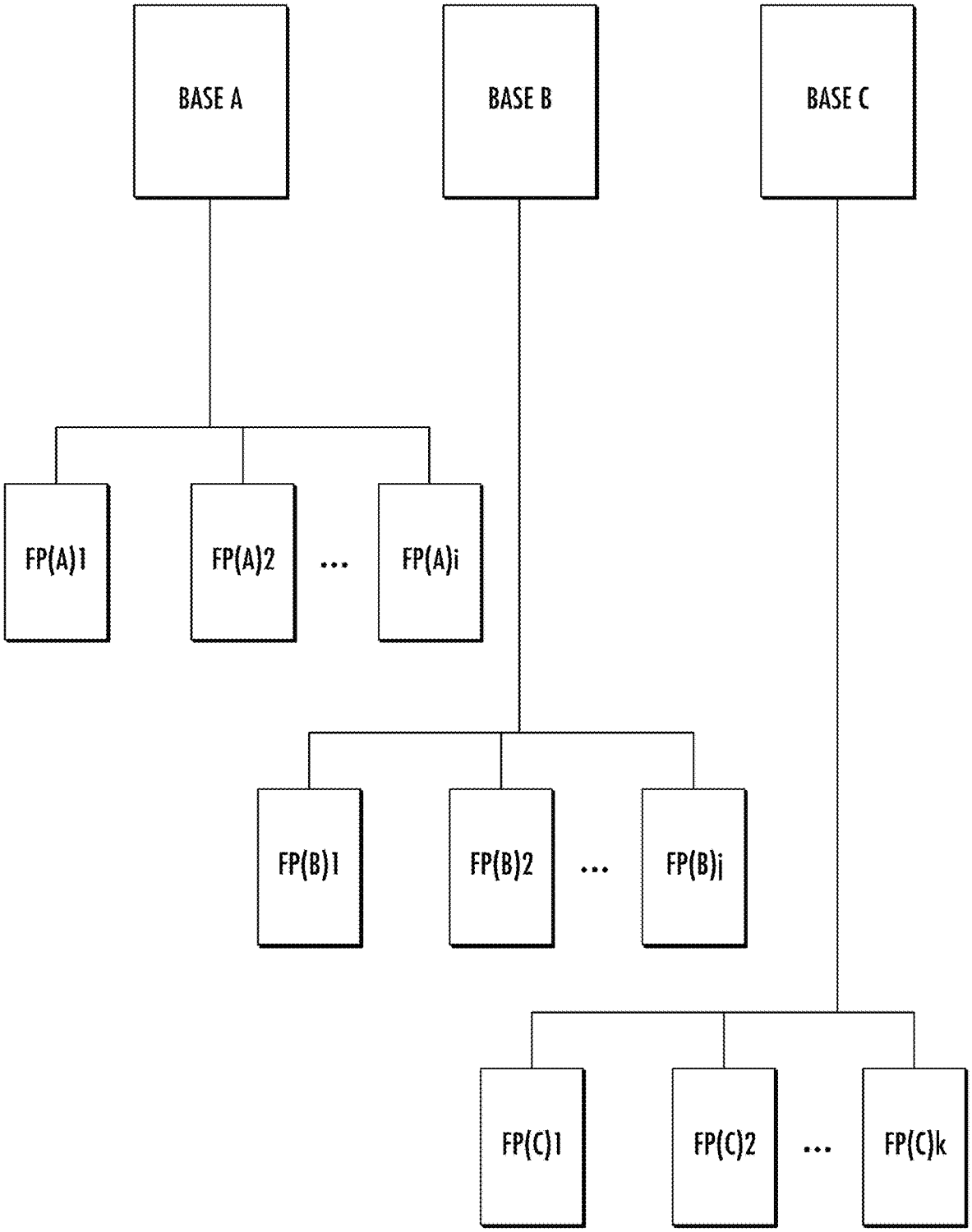
FIG. 16 shows multiple base templates and multiple resulting finished products from each of these templates.

FIG. 16 shows multiple base templates, base A, base B, and base C. These base templates may be referred to as base fit fabrics or BFFs. In an implementation, the base templates can be created during base prep and prelaser wash 816 (see FIG. 8). During finishing I, by using different wash 816 methods or recipes, each different base template can be created.

Finishing II can include laser finishing. Base A is lasered with different designs to obtain various final product based on base A (e.g., FP(A)1 to FP(A)i, where i is an integer). Base B is lasered with different designs to obtain various final product based on base B (e.g., FP(B)1 to FP(B)j, where j is an integer). Base C is lasered with different designs to obtain various final product based on base C (e.g., FP(C)1 to FP(C)k, where k is an integer). Each base can be used to obtain a number of different final designs. For example, the integers i, j, and k can have different values.

As described above and shown in FIG. 9, after finishing II, there can be additional finishing during post laser wash 919 and additional finishing 921. For example, during the postlaser wash, there may be additional tinting to the lasered garments. This tinting can result in an overall color cast to change the look of the garment.

In an implementation, laser finishing is used to create many different finishes (each a different product) easily and quickly from the same fabric template or BFF or "blank." For each fabric, there will be a number of base fit fabrics. These base fit fabrics are lasered to produce many different finishes, each being a different product for a product line. Laser finishing allows greater efficiency because by using fabric templates (or base fit fabrics), a single fabric or material can be used to create many different products for a product line, more than is possible with traditional processing. This reduces the inventory of different fabric and finish raw materials.

For a particular product (e.g., 511 product), there can be two different fabrics, such as base B and base C of FIG. 16. The fabrics can be part of a fabric tool kit. For base B, there are multiple base fit fabrics, FP(B)1, FP(B)2, and so forth. Using laser finishing, a base fit fabric (e.g., FP(B)1) can be used to product any number of different finishes (e.g., eight different finishes), each of which would be considered a different product model.

For example, FP(B)1 can be laser finished using different laser files (e.g., laser file 1, laser file 2, laser file 3, or others) or have different postlaser wash (e.g., postlaser wash recipe 1, postlaser wash recipe 2, postlaser wash recipe 3, or others), or any combination of these. A first product would be base fit fabric FP(B)1 lasered using laser file 1 and washed using postlaser wash recipe 1. A second product would be base fit fabric FP(B)1 lasered using laser file 2 and washed using postlaser wash recipe 1. A third product would be base fit fabric FP(B)1 lasered using laser file 2 and washed using postlaser wash recipe 2. And there can be many more products based on the same base fit fabric. Each can have a different product identifier or unique identifier, such as a different PC9 or nine-digit product code.

With laser finishing, many products or PC9s are produced for each base fit fabric or blank. Compared to traditional processing, this is a significant improvement in providing greater numbers of different products with less different fabrics and finishes (each of which in traditional processing consume resources, increasing cost, and take time). Inventory is reduced. The technique of providing base fit finishes or fabric templates for laser finishing has significant and many benefits.

Greater numbers of products can be achieved by using, changing, or varying the amount of damage. For example, from the same base fit fabric, there can be a first finished garment product FP(B)D0 without damage. A second finished garment product FP(B)D1 can have damage in a first particular positioning or first level (e.g., less damage or smaller holes). A third finished garment product FP(B)D2 can have damage in a second particular position (different from the first particular positioning) or second level (e.g., more damage or larger holes). In this way, more products can be obtained from the same base. And even more products can be obtained by combining varying damage and other variables, such as postlaser wash recipe, laser finish pattern, and tinting during postlaser wash (or may applied by, for example, spraying, just before postlaser wash).

Tinting can be used to give garments a used, vintage, or muddy appearance. Greater numbers of products can be achieved by using, changing, or varying the amount of tinting after laser finishing, such as during postlaser wash or applying, for example, by spraying, just before postlaser wash. For example, tinting is available in many different colors and shades of colors. Some examples of tinting colors include yellow, ecru, brown, red, green, blue, pink, cyan, magenta, and black. Tinting is used to change hue, cast, or tone of the indigo.

For example, from the same base fit fabric, there can be a first finished garment product FP(B)T0 without tint. A second finished garment product FP(B)T1 can tinting of a first color or first level. A third finished garment product FP(B)T2 can have tinting of a second color or second level, different from the second finished garment product. In this way, more products can be obtained from the same base. And even more products can be obtained by combining tinting and varying damage and other variables.

Figure 17:
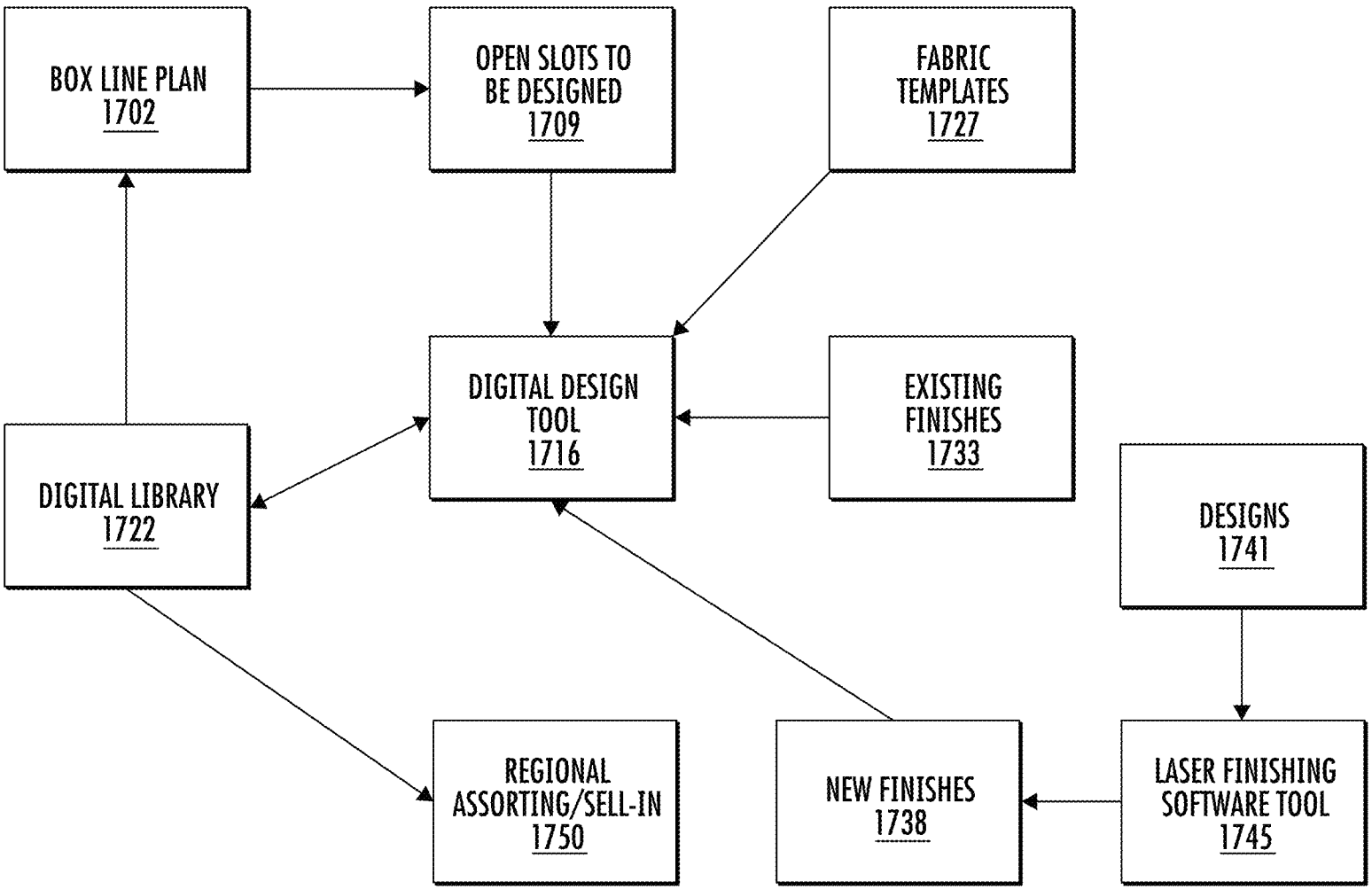
FIG. 17 shows a block diagram of a system, including a digital design tool with photorealistic preview, for creating, designing, producing apparel products with laser finishing.

FIG. 17 shows a block diagram of a system for creating, designing, producing apparel products with laser finishing. A box line plan 1702 is an internal and interim tool for communication between a merchandising group and design group. Through the box line plan, merchandising can communicate what needs to be designed by the design group. The box line plan can have open slots to be designed 1709.

There is a digital design tool 1716 merchants and design can use to click and drag finish effects (e.g., laser files) and tint casts over images of base washes in order to visualize possible combinations and build the line visually before the garment finish is actually finished by the laser. The visualizations can be by rendering on a computer system, such as using three-dimensional (3-D or 3D) graphics.

U.S. patent applications 62/433,746, filed Dec. 13, 2016, and Ser. No. 15/841,268, filed Dec. 13, 2017, which are incorporated by reference, describe a system and operating model of apparel manufacture with laser finishing. Laser finishing of apparel products allows an operating model that reduces finishing cost, lowers carrying costs, increases productivity, shortens time to market, be more reactive to trends, reduce product constraints, reduces lost sales and dilution, and more. Improved aspects include design, development, planning, merchandising, selling, making, and delivering. The model uses fabric templates, each of which can be used be produce a multitude of laser finishes. Operational efficiency is improved.

Designers can use the digital design tool to design products that are used to satisfy the requests in open slots 1709. Designs created using the digital design tool can be stored in a digital library 1722. Input to the digital design tool include fabric templates or blanks 1727 (e.g., base fit fabrics or BFFs), existing finishes 1733 (e.g., can be further modified by the tool 1716), and new finishes 1738. New finishes can be from designs 1741 (e.g., vintage design) captured using a laser finish software tool 1745, examples of which are described in U.S. patent applications 62/377,447, filed Aug. 19, 2016, and Ser. No. 15/682,507, filed Aug. 21, 2017. Digital library 1722 can be accessible by the region assorting and sell-in 1750. And the digital library can be used to populate or satisfy the box line plan.

Figure 18:
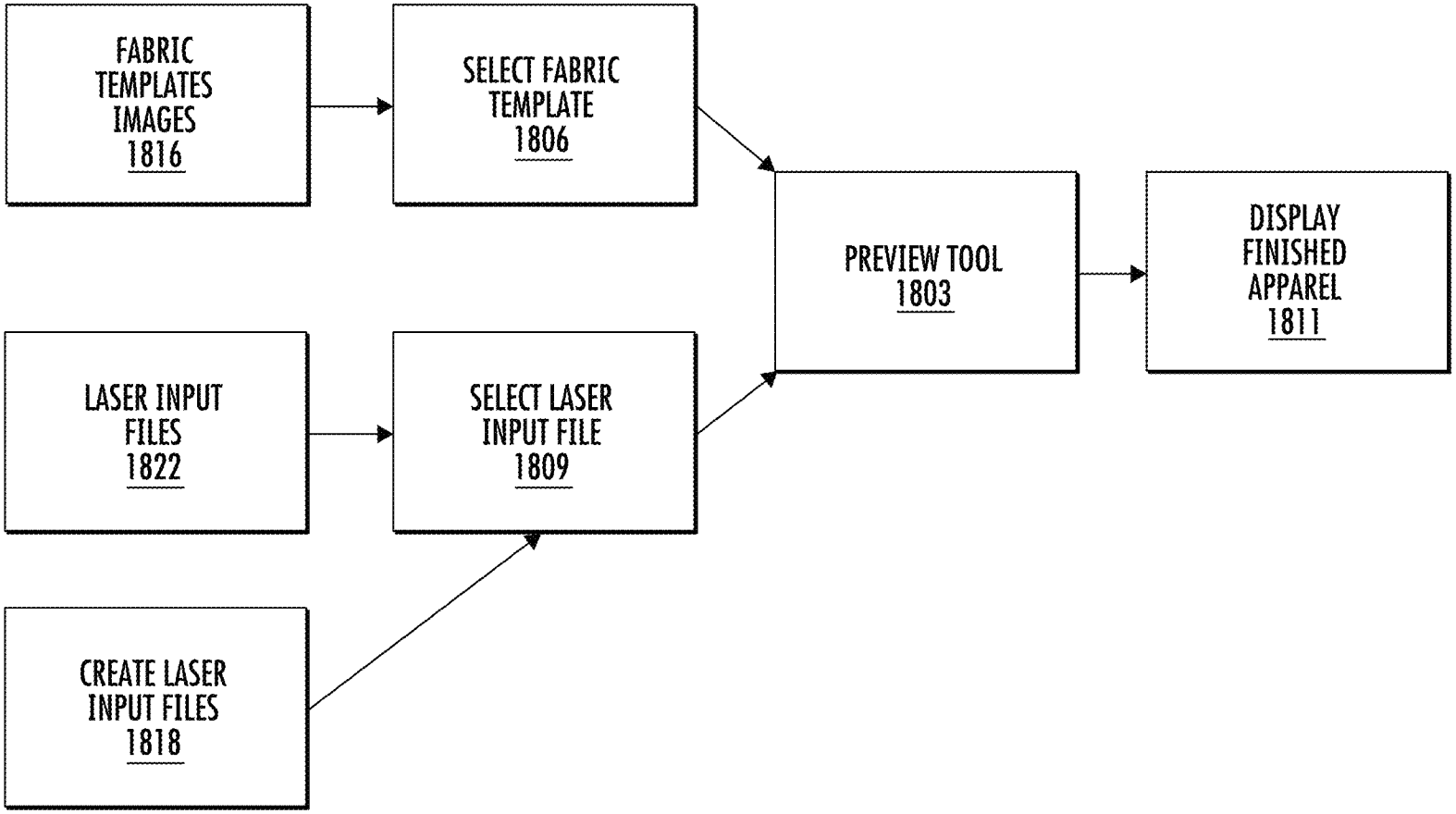
FIG. 18 shows a block diagram of a specific implementation of a preview tool.

FIG. 18 shows a block diagram of a specific implementation of a digital design tool, a preview tool 1803. Digital design tool 1716 can be representative of a collection of tools, such as an application suite, including desktop or mobile apps, or a combination.

Preview tool 1803 can be a single tool in a toolbox or toolkit used for laser finishing of garments, or the tool can be incorporated as a feature of another tool. The preview tool allows a user such as a clothing designer to preview on a computer screen or to generate a digital representation (e.g., image file, JPEG file, BMP file, TIFF file, GIF file, PNG file, PSD file, or others) of jeans in a selected base fit fabric or fabric template 1806 with a selected laser pattern 1809 (e.g., from a laser input file). With the digital representation, the user will be able to see or preview the jeans in the selected base fit fabric as if it had been burned with the selected laser input file, without needing to actually laser or burn the jeans.

With the preview tool, the appearance of the garment (e.g., jeans) will be of the finished garment product that the consumer will see (e.g., after postlaser wash). As discussed above, after laser finishing, the garment will have charred appearance, and damage holes will still be connected by fine yarns, and will not yet be tinted. After postlaser wash, the charring and yellowish hue due to the laser ash and residue will be washed away. The damage holes or openings will be opened and typically have a shredded appearance. The garment will have the selected tinting (e.g., color and level of color).

The preview tool displays on a screen or other visual output a preview image 1811 of the garment as it would appear to the consumer, after post laser wash. The preview image 1811 will be a photorealistic image in color. The preview image may be displayed in using a 8-bit or greater color depth, 16-bit or greater color depth, 24-bit or greater color depth, or 32-bit or greater color depth. This is in contrast to a computer screen at operator's console of a laser finishing machine, which typically only shows black and white images. The console is primarily used for alignment rather than design, and using black and white images can provide increased contrast (as compared to color images) which aids the operator in achieving proper alignment.

The console is directly attached or connected to the laser, while the preview tool is front end tool that executes remotely from the computer and connected via a network. The preview tool can be directly attached or connected to the laser, but typically not because laser finishing is typically performed at a different physical location from where garments are designed. For example, a design facility may be in San Francisco, while the laser finishing center may be Las Vegas or outside the United States (e.g., China, Mexico, Bangladesh, Sri Lanka, Vietnam, India, Malaysia, Indonesia, Egypt, Brazil, and others).

After a garment has been designed and previewed using the preview tool, the information can be transferred via the network to the laser finishing tool and its console. For example, the preview tool can execute on a desktop computer, mobile device (e.g., smartphone or tablet computer), or using a Web browser.

Some files are described as being of an image file type. Some examples of image file types or file formats include bitmap or raster graphics formats including IMG, TIFF, EXIF, JPEG, GIF, PNG, PBM, PGM, PPM, BMP, and RAW. The compression for the file can be lossless (e.g., TIFF) or lossy (e.g., JPEG). Other image file types or file formats include vector graphics including DXF, SVG, and the like.

Bitmaps or raster graphics are resolution dependent while vector graphics are resolution independent. Raster graphics generally cannot scale up to an arbitrary resolution without loss of apparent quality. This property contrasts with the capabilities of vector graphics, which generally easily scale up to the quality of the device rendering them.

A raster graphics image is a dot matrix data structure representing a generally rectangular grid of pixels, or points of color, viewable via a monitor, paper, or other display medium. A bitmap, such as a single-bit raster, corresponds bit-for-bit with an image displayed on a screen or output medium. A raster is characterized by the width and height of the image in pixels and by the number of bits per pixel (or color depth, which determines the number of colors it can represent).

The BMP file format is an example of a bitmap. The BMP file format, also known as bitmap image file or device independent bitmap (DIB) file format or simply a bitmap, is a raster graphics image file format used to store bitmap digital images, independently of the display device. The BMP file format is capable of storing two-dimensional digital images of arbitrary width, height, and resolution, both monochrome and color, in various color depths, and optionally with data compression, alpha channels, and color profiles.

The fabric template can be selected from a library of fabric template images 1816 or may be a new image uploaded or provided by the user. Each fabric template images is an image file of a jeans in a base fit fabric or other material. For each jeans model or fit (e.g., models or fits 311, 501, 505, 511, 515, 541, 569, 721, and others), there would be one image in each different material or base fit fabric.

The laser input file can be selected from a library of laser input files 1822 (e.g., files created from vintage jeans or from a group of designers), a file 1818 created by the user, or a file uploaded or provided by the user. For example, the user may have created the laser pattern (contained within a laser input file) manually using a graphical or image editing tool (e.g., Adobe Photoshop and similar photo editing programs). Or the laser pattern may have been created by another, such as selected from a library of laser files. The laser pattern may be generated by a computer or automated process, such as may be used to obtain a laser pattern from vintage jeans. The user will be able to see the results of a burn, make any manual changes or alterations to the pattern (such as additional changes to a vintage jean pattern in a digital image file) and preview the results again. The preview tool allows a user to make and see changes, to the user can obtain feedback faster than having to laser jeans to see the results and also avoiding unneeded waste (e.g., preliminary versions of burned jeans).

Each digital representation can be saved as separate images, and a group or set of the images can be a called brief of collection of jeans. The preview tool can be used for merchandising, such as generating images of a proposed line of products for a particular season, and these images can be shared among members of a team to discuss any additions, changes, or deletions to a collection.

A table A below presents a pseudocode computer program listing of sample software code for a specific implementation of a preview tool 1803 for displaying finished apparel 1811 for a given fabric template input (e.g., base fit fabric image) and laser input file. A specific implementation of the source code may be written in a programming language such as Python. Other programming languages can be used.

TABLE A

```
PREVIEW PATTERN TOOL
SETUP: file selection object
GET: input file from user selection
ASSIGN: default blur options for high and low settings
ASSIGN: input and conversion dpi settings
FUNCTION: Import File (File List, File Index):
  IMPORT: file being previewed
  COMPUTE AND SET: resolution conversion factor
  CALCULATE: optional resized image for use during preview
  RETURN: input file and resized input file
RUN: Import File (File List, File Index)
CREATE: plotting object to display results to user
SETUP: custom colors for preview options
ASSIGN: color and color separation variables
SETUP: graphical user interface interactions buttons, sliders, etc.
FUNCTION: Update (Value):
  READ: current display settings
  CHECK: which user interactions are being changed
  ASSIGN: operation variable value
  PERFORM: user specified operation
  REDRAW: plot of image preview to user
FUNCTION: Reset (Event):
  RESET: all default settings for image preview
FUNCTION: Change Color (color):
  SET: color of base color for preview
  REDRAW: plot of image preview to user
PLOT: current state of file object
```

A specific version of the preview tool overlays a fabric template input file and a laser input file, and then generates an image to display them together as a representation of the laser-finished apparel. The laser input file is aligned to the garment in the fabric template input file, so that the positioning of features in the laser input file are at appropriate positions or places on the garment. The alignment may be by using alignment marks that are in the input files. The alignment may be an automated alignment or scaling, or a combination.

Brightness, intensity, opacity, blending, transparency, or other adjustable parameters for an image layer, or any combination of these, are selected or adjusted for the laser input file, so that when the laser input file is overlaid above the fabric template image, the look of the garment will appear of simulate the look of a garment had been burned by a laser using that laser input file.

Adjustable parameters such as opacity can be used to blend two or more image layers together. For example, a layer's overall opacity determines to what degree it obscures or reveals the layer beneath it. For example, a layer with 1 percent opacity appears nearly transparent, while one with 100 percent opacity appears completely opaque.

Further, a dots per inch (dpi) of the combined image can be adjusted to more properly simulate the look of a garment more closely with a burned garment. Dots per inch refers to the number of dots in a printed inch. The more dots, the higher the quality of the print (e.g., more sharpness and detail). By reducing the dpi of the image, this will reduce the image quality, resulting a blurring of the image. In an implementation, the preview tool reduces a dpi of the combined image, to be of less dpi than the fabric template input file or the laser input file. By blurring the preview image, this results in improved simulation that corresponds better to a burned laser garment. When burning a garment, the garment material or fabric typically limits the resolution of the result to less than that of the input file.

In an implementation, the dpi of the laser input file is about 72 dpi, while the dpi of the preview image is about 34 dpi. In an implementation, the dpi of the fabric template input file and laser input file are about 36 dpi or above, while the dpi of the preview image is about 36 dpi or lower.

Figure 19:
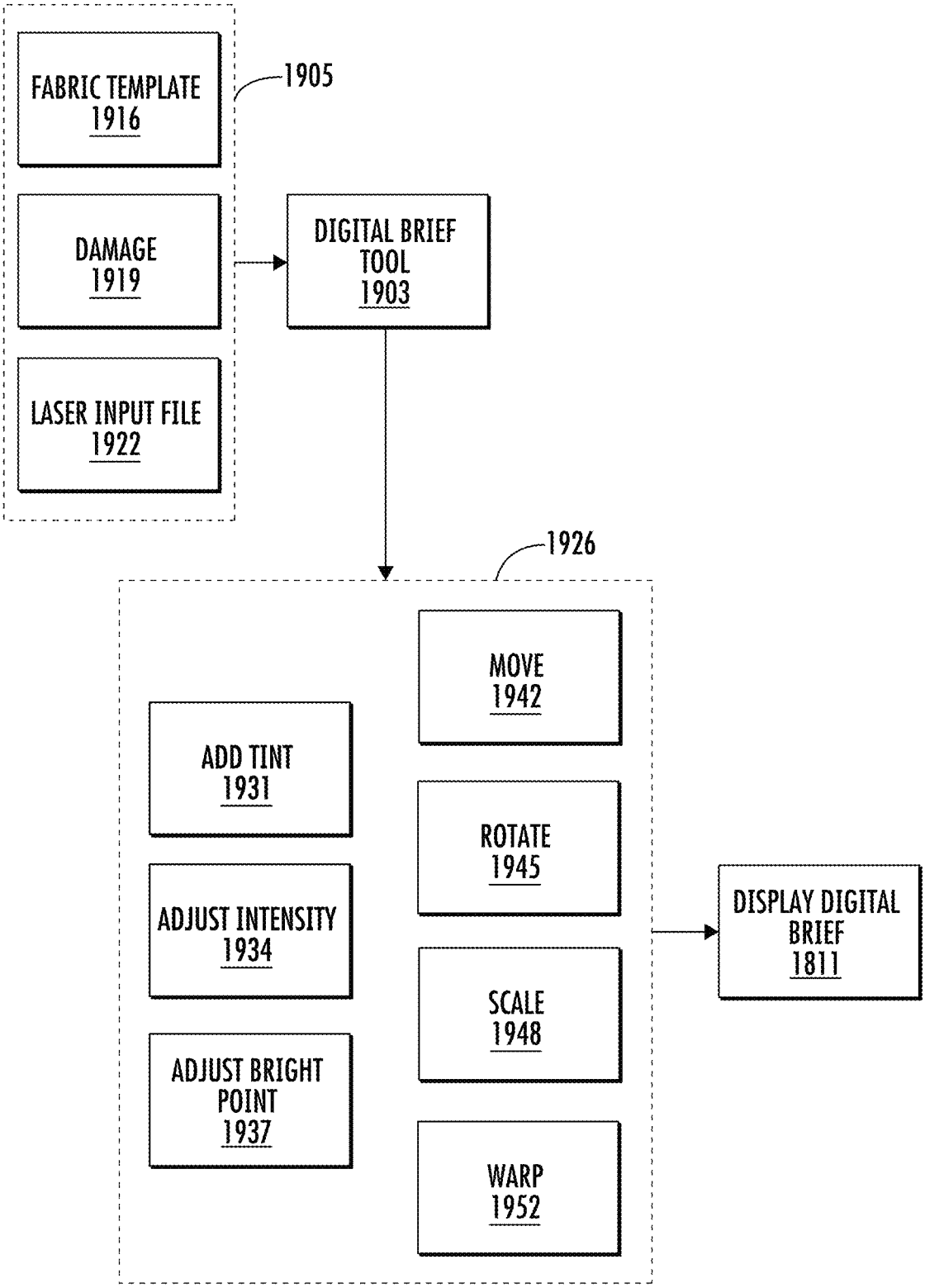
FIG. 19 shows a block diagram of a brief tool.

FIG. 19 shows a block diagram of a digital brief tool 1903, which also like preview tool 1803, provides a real-time preview of an appearance of pair of jeans when a finishing pattern is applied by burning using a laser input file. The digital brief tool has additional features to allow more flexible designing of jeans.

It should be understood that the invention is not limited to the specific flows and steps presented. A flow of the invention may have additional steps (not necessarily described in this patent), different steps which replace some of the steps presented, fewer steps or a subset of the steps presented, or steps in a different order than presented, or any combination of these. Further, the steps in other implementations of the invention may not be exactly the same as the steps presented and may be modified or altered as appropriate for a particular application or based on the data or situation.

As input, the digital brief tool takes three types of digital assets 1905, fabric template input 1916, damage input 1919, and laser input file 1922. Fabric template input 1916 and laser input file 1922 are similar to the inputs for the preview tool. Damage input 1919 is an image of damage (e.g., holes, rips, shredded regions, or openings of various shapes and sizes) that can be burned by a laser into jeans. The digital brief tool overlays the damage and laser input files over the fabric template.

The user selects a fabric template input, which an image of a jeans style in a particular base fit fabric. The user can optionally select one or more damage inputs. If a damage input is selected, the damage input will be a layer that overlays the fabric template layer. As for the preview tool, the user selects a laser input file with laser pattern and overlays the fabric template layer. As the user selects the inputs, the user will be able to see in real time the inputs and any changes or updates in a preview image or brief.

After the inputs are selected, the user can select and perform one or more operations 1926 on the inputs using the digital brief tool. These operations including adding tint 1931, adjusting intensity 1934, adjusting bright point 1937, move digital asset 1942, rotate digital asset 1945, scale digital asset 1948, and warp digital asset 1952. As the user selects and performs one or more operations, the user will be able to see in real time the changes or updates in the preview image or brief.

After the fabric template input, the user can add tinting 1931. Tinting will adjust the hue of the color of the fabric template input. Tinting is representative of the tinting which can be added during the postlaser wash or finishing II, described above. The user will be able to select a tint color, and this tint color will be blended with the existing color of the fabric template input. The amount or intensity of the tinting can be increased or decreased, such as by using a slider bar.

The user can adjust intensity 1934. In an implementation, intensity adjusts a weight matrix by a percentage of each value in the array. In an implementation, intensity (or brightness) adjusts an opacity of a generated adjustment layer (see hue saturation lightness adjustment layer described below). The greater the opacity, the more opaque this layer will appear in the preview or brief image. The less the opacity, the less opaque this layer will appear in the preview or brief image; the layer will appear more transparent so that the layer beneath will show through more.

When increasing brightness, the opacity of the adjustment layer increases, and since the adjustment layer is above the fabric template input, the generated adjustment layer will become more prominent or visible, thus making this layer (which has the wear pattern) brighter. Similarly, when decreasing brightness, the opacity of the adjustment layer decreases, the generated adjustment layer will become less prominent or visible, thus making this layer (which has the wear pattern) less bright or fainter. The amount of the intensity can be increased or decreased, such as by using a slider bar.

The user can adjust bright point 1937. Bright point adjusts the effect of the laser input file on the fabric template input. In an implementation, bright point adjustment changes a midpoint of a grayscale, creating a piecewise linear mapping of the pattern file.

Increasing the bright point will increase an effect of the laser pattern (e.g., causing greater laser pattern highlights) in the laser input file on the fabric template input, while decreasing the bright point does the opposite (e.g., diminishing laser pattern highlights). The bright point adjustment can be analogous to changing a pixel time or the time that the laser stays at a particular position for a given input from the laser input file. The amount of the bright point can be increased or decreased, such as by using a slider bar.

The user can move 1942 or reposition a selected digital asset. For example, a damage input (or fabric template or laser file) may be moved to a position desired by the user. The user can rotate 1945 a selected digital asset. For example, a damage input (or fabric template or laser file) may be rotated to any angle relative to the other layers as desired by the user.

The user can scale 1948 a selected digital asset. This scaling can be locked, maintaining the original aspect ratio of the digital asset, or can be unlocked, such that the user can change the aspect ratio. The user can warp 1952 a selected digital asset. With warping, the user can adjust an aspect ratio of a portion of the digital asset differently from another portion. For example, one portion of a damage input (or fabric template or laser file) can be squished (e.g., right and left edges of image pushed toward each other) while another portion is expanded (e.g., right and left edges of image pulled away from each other).

After the user has performed selected operations 1926, the digital brief tool shows an image of the jeans with the laser finishing pattern, including any tinting, damage, or other adjustments, as created by the user. This image can be saved and viewed again later. A user can create multiple designs, and these can be saved together as part of a collection.

In an implementation, a technique provides a three-dimensional (3-D or 3D) previewing feature of a laser finishing design tool, such as a digital brief tool (e.g., digital brief tool 1903 of FIG. 19). For example, after creating or selecting a product, the user can view the product (e.g., garment) in three dimensions or 3D. This 3D preview feature allows a user to see a 360-degree preview (in any direction or orientation) of a garment with a laser finishing pattern as the garment would appear when it is worn by a person. U.S. patent applications 62/877,830, filed Jul. 23, 2019, and Ser. No. 16/701,095, filed Dec. 2, 2019, describe further details of three-dimensional rendering of laser-finished garments and is incorporated by reference.

In an implementation, a digital design tool generates a three-dimensional photorealistic visualization garment with a selected finishing pattern). The garment will appear as though it is worn by a person, with simulated wrinkling or simulated shadowing, or both. The appearance of a worn garment is in contrast to a flat garment, such as when a garment is lying on a table or shelf (which is generally a two-dimensional image). Additionally, when the wear pattern (which is in the laser file as a two-dimensional image) is mapped onto the garment, the wear pattern is transformed, converted, or mapped (such as by using mathematical calculations) to have a three-dimensional appearance, similar to situation of how the garment pieces are mapped the three-dimensional model.

The digital design tool allows various and combinations of manipulations of the three-dimensional photorealistic visualization. For example, in an implementation, the user can reposition the light source as desired, which will change the appearance of the shadowing. For example, the light source can be from the front, back, left side, right side, above, below, or other positioning.

In an implementation, the user can change the rotation angle (or angular point of view) through which the garment is viewed. For example, the user can rotate the garment 360 degrees in the X direction (e.g., left and right). The user can rotate the garment 360 degrees in the Y direction (e.g., left and right). And the user can rotate the garment. And the user can rotate the garment in any angle in a combination of X and Y directions. At any angle of rotation, the garment can be zoomed in or zoomed out. When zoomed in, the user can see, for example, the fine details of the material or wear pattern. When zoomed out, the user can see, for example, the entire garment from various perspectives.

In an implementation, the user can change a positioning of the garment itself. For example, the user can reposition the garment to a left-hand side position. The user can reposition the garment to a right-hand side position. The user can reposition the garment to a further back position. The user can reposition the garment to a further forward position.

Figure 20:
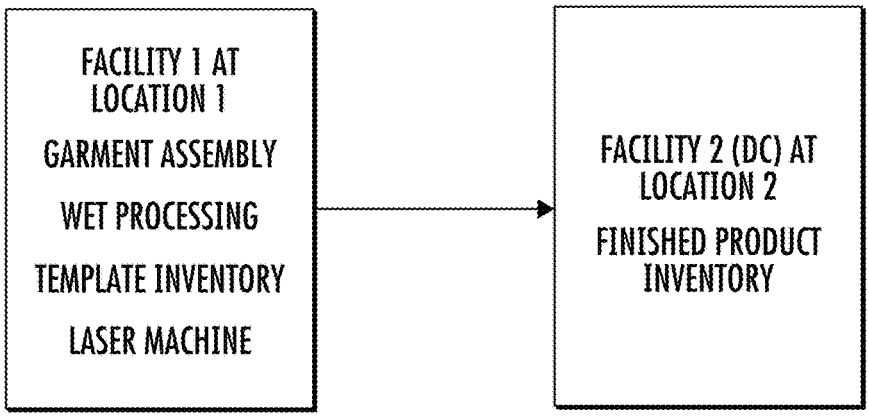
FIGS. 20-22 show various approaches for staging the base fit fabrics or base templates.
Figure 21:
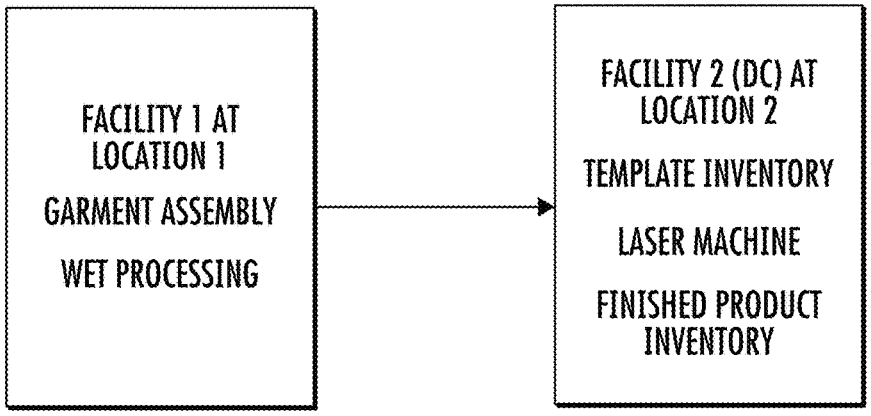
Figure 22:
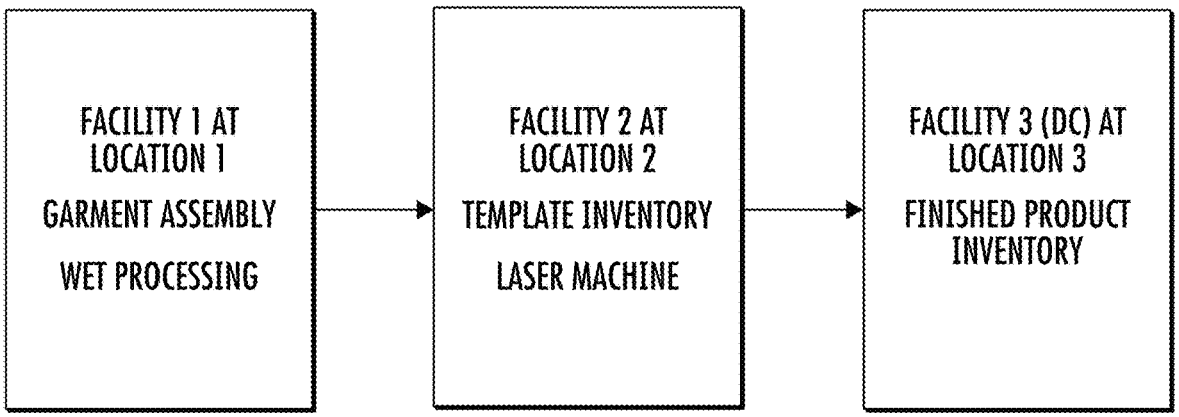

FIGS. 20-22 show various approaches for staging (e.g., storing inventory) the base fit fabrics or base templates. In FIG. 20, there is a first facility at a first location and a second facility at a second location, different from each other (in different buildings). The second facility may be referred to as a distribution center and stores an inventory of the finished products. As an example, the first facility can be in China or Asia. The second facility can be in the United States (e.g., distribution center for the U.S. market).

The first facility is handles assembling the garments, wet processing (e.g., base wash), storing an inventory of the base templates, lasering of the garment by a laser finishing machine when needed. The finished product, output from the laser machine, is shipped to the second facility for inventorying.

In FIG. 21, compared to the approach in FIG. 20, the first facility no longer stores the blank template inventory, but ships the templates after base wash to the second facility. The second facility stores an inventory of the base templates, and has laser machines that can laser finish the garments. The resulting finished products are also inventoried at the second facility. In this approach, the time from finished product to store is shortened (compared to the approach in FIG. 18) because typically the second facility (e.g., distribution center) is closer to, for example, the retail stores and location of the purchasers. This approach may be considered in-market final finishing because laser finishing occurs in the same location as the market the facility serves.

In FIG. 22, compared to the approaches in FIGS. 20 and 21, there are three facilities. The third facility is a distribution center (similar to the second facilities in FIGS. 20 and 21) and stores the finished products. The second facility handles storing inventory of the base templates and lasering of the garments. The first facility handles assembling the garments and base wash. The first facility ships the base templates to the second facility, which inventories them. After lasering, the second facility ships the finished products to the third facility.

As an example, the first facility can be in China or Asia. The second facility can be in Mexico, or other location geographically closer to the third facility than the first facility. The third facility can be in the United States (e.g., distribution center for the U.S. market).

With laser finishing, base templates can made, stored, and moved or shipped as needed to various facilities for laser finishing. In a laser finishing process flow for apparel, the same base template (or base fit fabric or BFF) can be used for many different final products. Many base templates can manufactured and then stored in inventory for later use in laser finishing.

However, an issue that can arise when storing base templates is that the color of the fabric of the base templates can change or fade over time, which can be referred to as a color loss. For example, this color change can be a yellowing of the dyed material or fabric. For jeans and denim garments, ozone molecules that are in the atmosphere can interact with the indigo dye in the garments to cause a yellowing or fading over time.

Ozone is a triatomic molecule of oxygen and a strong oxidizing agent, and is a pollutant that is found naturally in the atmosphere. Ozone is also produced by a combined action of sunlight, nitrogen oxides, and oxygen. Under the sun's ultraviolet radiation of shorter wavelength (e.g., less than 420 nanometers), nitrogen dioxide undergoes photolysis or decomposition by light to form nitrogen oxide and atomic oxygen. This atomic oxygen combines with molecular oxygen to form an ozone molecule. This ozone reacts with nitric oxide to form molecular oxygen and nitrogen dioxide; this cycle repeats over and over.

Ozone is a natural gas composed of three atoms of oxygen. Ozone has a chemical symbol O3, is blue in color, and has a strong odor. Normal oxygen (O2), we breathe, has two oxygen atoms and is colorless and odorless. Ozone is a powerful oxidant.

Low level ozone (or tropospheric ozone) is an atmospheric pollutant. It is not emitted directly by car engines or by industrial operations, but formed by the reaction of sunlight on air containing hydrocarbons and nitrogen oxides that react to form ozone directly at the source of the pollution or many kilometers down wind.

Figure 23:
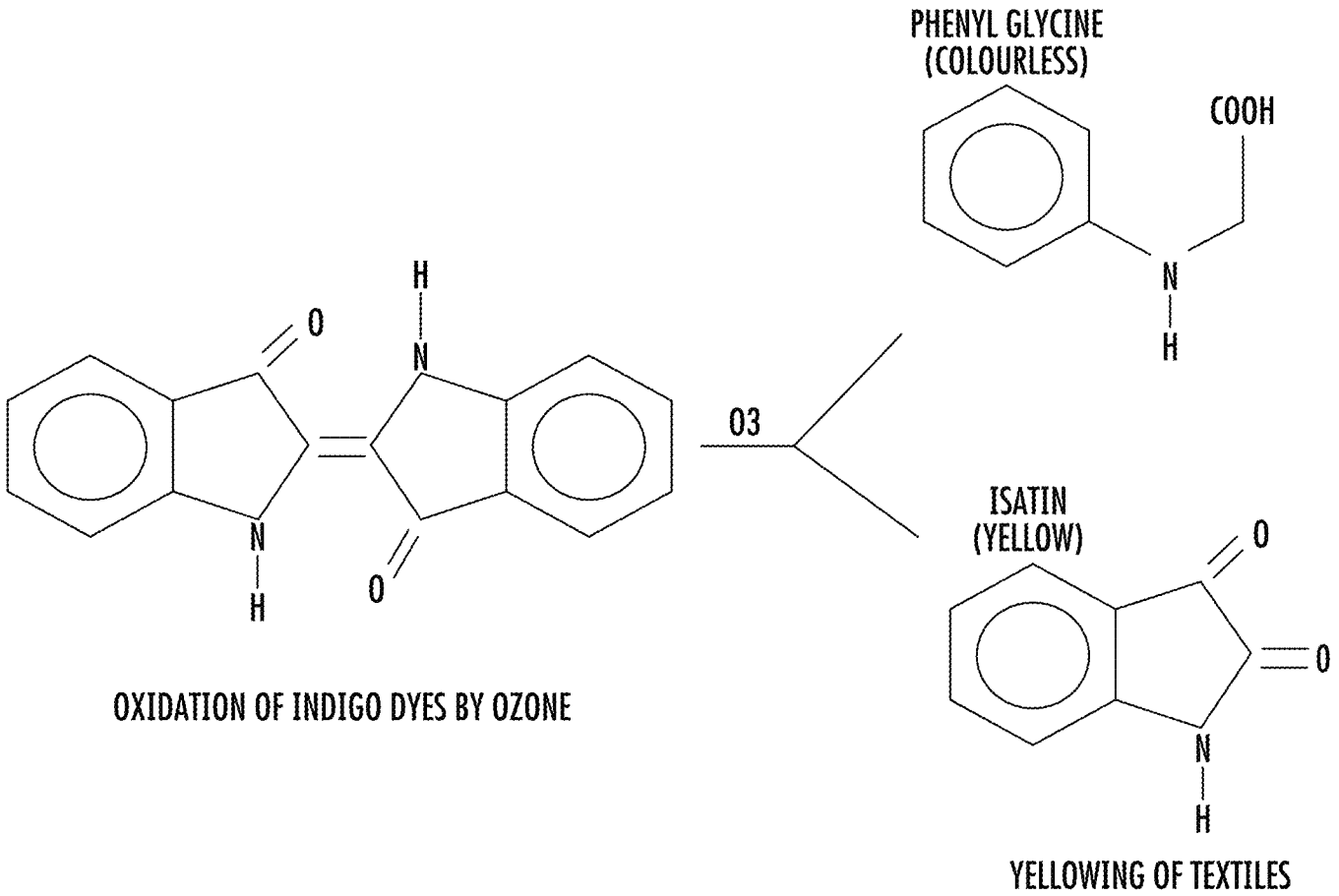
FIG. 23 shows an oxidation reaction of an indigo dye by ozone

FIG. 23 shows an oxidation reaction of an indigo dye by ozone. A mechanism for indigo color change or fading is the addition of ozone to the unsaturated carbon-carbon conjugated bonds, resulting in subsequent degradation of the indigo molecule. When in contact with ozone, the indigo dye breaks apart into two byproducts (phenyl glycine and isatin). Phenyl glycine is colorless. But isatin is yellow in color, and causes the indigo-dyed blue material to turn to yellow or yellowish or fade. It has been determined that 1 gram of ozone can destroy 10.9 grams of indigo dye.

Ozone destroys indigo dye or color on denim in a manner similar to bleaching. The mechanism of ozone fading occurs by oxidative cleaving of the indigo dye molecule. The mechanism is the addition of ozone to the unsaturated carbon-carbon conjugated bonds, resulting in subsequent degradation of the indigo molecule. Ozone molecule breaks up into an oxygen molecule and atomic oxygen where atomic oxygen acts as the active species in saturating bonds by addition mechanisms.

Based on molecular weight calculation, 1 gram of ozone can destroy about 10.9 grams of indigo dye. Since the ozone-induced oxidation of indigo produces a compound (isatin), which is yellow in color, denim garments turn yellow due to ozone fading which destroys the authentic denim look, which needs to undesirable.

In the textile industry, ozone fading is a significant problem. The radiation emitted by light sources (e.g., ultraviolent-producing lights, incandescent lights, halogen lamps, LED lights, and fluorescent lights) used in stores to illuminate the display of garments emit or generate a significant amount of ozone, which causes bleached or indigo dyed garments to turn yellow after prolonged exposure. Lighter garments have had issues of folding marks where exposed edges have turned yellowish. Sealed samples have had to be recalled due to rapid yellow fading. Thus, a solution to the ozone fading problem is needed.

Regardless of the chemicals, process steps involved, and types of anti-ozone softeners used, the ozone fading problem is still common for all finishes, especially light finishes. Finishes with moisture management properties (e.g., performance materials) have been found to give inferior wicking and absorbency results when used together with anti-ozone softeners. Anti-ozone softeners and wicking enhancing chemicals work in an inverse proportional relationship. Specifically, the greater the amount of anti-ozone softeners used, this will generally diminish the effect of the wicking enhancing chemicals. And the greater the amount of wicking enhancing chemicals used, this will generally diminish the effect of the anti-ozone softeners.

Figure 24:
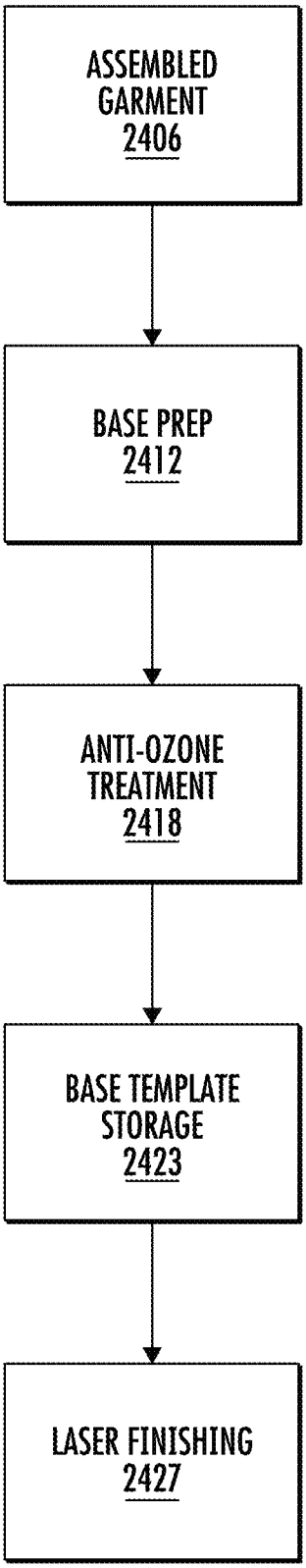
FIG. 24 shows a technique to prevent ozone degradation of base templates before laser finishing.

An anti-ozone softener or anti-ozone agent will provide better ozone fastness properties. The agent is carefully blended to achieve the end result containing efficient waxing property to prohibit damage on the color and ozone fastness when treated material is exposed to the sun. An anti-ozone agent should improve ozone fastness, does not influence the shade or casts of dyed garments, and does not affect the degree of whiteness of brightened goods FIG. 24 shows a technique to prevent ozone degradation of base templates before laser finishing. Assembled garments 2406 are processed through a base preparation process 2412 (e.g., prelaser wash 916 or finishing I 1508) to turn them into base templates. Base preparation process typically involves wet processing. After base preparation, base templates undergo an anti-ozone treatment 2418. After anti-ozone treatment, the based base templates are stored 2423 (e.g., in a warehouse) for subsequent laser finishing 2427. The anti-ozone treatment prevents yellowing of the stored base templates (e.g., indigo dyed garments) while they are stored. This allows greater numbers of base templates to be inventoried without the issue of base template degradation due to the ozone pollution.

In an implementation, as shown in FIG. 24, the anti-ozone treatment can be a separate step after base preparation. In other implementation, the anti-ozone treatment can be included in the base preparation process.

Figure 25:
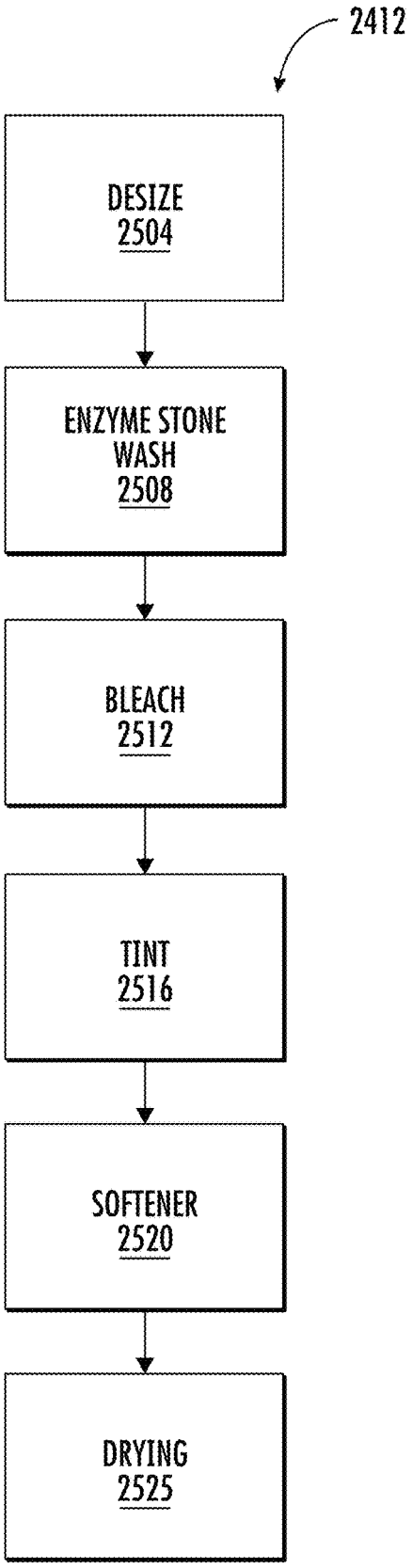
FIG. 25 shows a flow for a base preparation process for an indigo-dyed denim base template.

FIG. 25 shows a flow for a base preparation process 2412 for an indigo-dyed denim base template. In a step 2504, desizing is performed. Desizing removes starch and other sizing materials from the material. In an implementation, desizing is performed in a washing machine for about 15 minutes (or shorter or longer, as needed).

Some natural sizing agents include starch and starch derivatives, cellulosic derivatives (e.g., carboxymethylcellulose (CMC), methylcellulose, or oxyethylcellulose), or protein-based starches (e.g., glue, gelatin, or albumen). Some synthetic sizing agents include, for example, polyacrylates, modified polyesters, polyvinyl alcohols (PVA), or styrene or maleic acid copolymers.

Desizing involves impregnation of the fabric with the desizing agent, allowing the desizing agent to degrade or solubilize the size material, and to wash out the degradation products. Some examples of desizing processes include: enzymatic desizing of starches on cotton fabrics, oxidative desizing, acid desizing, removal of water-soluble sizes, and fermentative desizing.

In a step 2508, an enzyme stone wash is performed, which is used to achieve abrasion and a worn-out washed down character to the fabric. In an implementation, the enzyme stone wash is performed using pumice stone in the washing machine for about 30 minutes (or shorter or longer, as desired to achieve the desired effect). For example, this wash can include the enzyme and pumice stone (or other abrasive material) in water.

In a step 2512, a bleach wash is performed. The bleach wash reduces or lightens a color of the indigo dyes to create lighter shade base templates. In an implementation, the bleach wash is performed using chlorine bleach in the washing machine for about 10 minutes (or shorter or longer, as desired to achieve the desired effect). For example, this wash can include bleach in water.

In a step 2516, tinting or tint wash is performed. This tint wash changes a cast or tone of the denim to have a different color, other than indigo (e.g., yellowing or reddish color cast). The tinting can give the denim a worn look. In an implementation, tinting is performed by the addition of small amounts dyes to the washing machine for about 10 minutes (or shorter or longer, as desired to achieve the desired effect). For example, this wash can include a tint dye in water.

In a step 2520, the garment is washed with a softener. The softener imparts a pleasant and nice hand feel to the garment, and can add special properties such as wicking improvement. Since step 2520 is a final wet step before drying, this step can be considered a final rinse step. Optical brighteners can also be added during the softener wash, to enhance the whiteness of the fabric, such as for lighter shade denim base templates.

An anti-ozone agent can be added to the softener wash to impart anti-ozone properties to the material. When the anti-ozone agent is used in the softening wash, a separate anti-ozone treatment step 2418 is not needed. For example, this wash can include the anti-ozone agent and softener in water.

Some examples of anti-ozone agents that can be used during the softener wash include antioxidants like sodium bisulfate and ethylene diamine. These agents undergo decomposition and protect indigo dyes from yellowing. Other examples include anti-ozone softeners, such as amine-based softeners or modified fatty acid softeners. An anti-ozone softener forms a film over the fabric surface, which prevents the indigo dye from reacting with ozone.

In a step 2525, the garment is dried. This can include a water extraction, such as a high-speed spin cycle at about 1000 revolutions per minute (rpm) for about 30 minutes. And the drying process can include drying in a machine drying at about 70 degrees Celsius for about 30 minutes (or shorter or longer, as needed).

In an implementation, ascorbic acid or vitamin C is used as an anti-ozone treatment for denim and indigo-types materials, to prevent yellowing due to yellowing. This is especially useful for processing and the storage of base templates fabrics before laser finishing. Ascorbic acid can be added in the process as part of the softener wash, instead of using other products such as sodium bisulfate, ethylene diamine, amine-based softeners, or modified fatty acid softeners.

Ascorbic acid exists in two forms, ascorbic acid and sodium ascorbate. Neither is considered a hazardous chemical and is a nutrient that humans can consume. First, vitamin C does not lower the dissolved oxygen as much as other chemicals do. Second, vitamin C is not toxic to aquatic life at the levels used for anti-oxidization treatment. Although ascorbic acid is mildly acidic and, in large doses, will lower the pH of the treated water, sodium ascorbate is neutral and will not affect the pH of the treated water or the receiving stream. Both forms of vitamin C are stable, with a shelf life of at least one year in a dry form if kept in a cool, dark place. Once it is placed in solution, however, vitamin C degrades in a day or two.

Ascorbic acid is an environmental friendly and safe product, consumable by humans as vitamin C. It has been determined the ascorbic acid imparts excellent anti-ozone properties to indigo-dyed materials. There do not need to be changes to the base preparation process since the base template can be dosed with ascorbic acid in the last washing step or final rinse (e.g., softener wash) before drying the base template.

Colorfastness to ozone failure is highly prominent as the base shade is lighter. Therefore the trials were carried out in such a way that the optimum dosage could effectively allow even the lightest finishes to easily pass the test. In an implementation, about a 2.0 grams per liter (or greater) concentration of ascorbic acid in the final rinse (e.g., softener wash) was determined to be sufficient to impart anti-ozone properties. In an implementation, a range from about a 2.0 grams per liter to about 2.5 grams per liter concentration of ascorbic acid in the final rinse (e.g., softener wash) was determined to be sufficient to impart anti-ozone properties.

When ascorbic acid is used, this can be added to the constituents or chemicals used in a typical softener wash such as using a fabric softener component. However, the final wash may include only the ascorbic acid constituent or the ascorbic acid constituent without any fabric softener constituent. In the situation when a fabric softener constituent is not used, the wash may be referred as the final wash, ascorbic acid wash, vitamin C wash, or other name, instead of softener wash. However, the wash may continue to be referred as softener wash, as it has been known in the trade or industry, even when a fabric softener constituent is not used.

For example, in an implementation, the softener wash can include ascorbic acid and water, and no softener. The softener wash can include an antioxidant constituent and water, and no softener. The softener wash can include an anti-ozone agent and water, and no softener. The antioxidant constituent can be sodium bisulfate and ethylene diamine, instead of ascorbic acid and sodium ascorbate. The antioxidant constituent can be sodium bisulfate or ethylene diamine, instead of ascorbic acid and sodium ascorbate.

Trials were performed at dosages for ascorbic acid of about 1.0 to 1.5 grams per liter, about 1.5 to 2.0 grams per liter, about 2.5 to 3.0 grams per liter, about 3.0 to 3.5 grams per liter, and about 3.5 to 4.0 grams per liter. The results of the trials for visually evaluated for their effectiveness in preventing ozone degradation. When not sufficient amounts of ascorbic acid were used (e.g., 0.2-0.5 grams per liter), there was not a noticeable improvement for material treated with ascorbic acid as compared to the material not treated any ascorbic acid when exposed to ozone during testing.

Greater amounts of ascorbic acid than 2.0 grams per liter can used and be effective. However, when greater amounts of ascorbic acid are used and there is no improvement in the prevention of ozone degradation, this would be an unnecessary waste of ascorbic acid and unnecessary cost. Further with the increase of the dosage to, for example, about 10 grams per liter, some garments were noticed with slight mist-like precipitation which was not desirable. Therefore the wash trials conducted were varied between about 1.0-5.0 grams per liter solutions at 0.5-gram intervals. At 3 grams per liter solution of ascorbic acid, good results were improved, and further increases in the concentration of ascorbic acid did not appear to improve the results.

In an implementation, for good results for prevention of ozone degradation, a final rinse including from about 2.0 grams per liter of ascorbic acid to about 4.0 grams per liter of ascorbic acid is used for preparing base templates before laser finishing. In another implementation, a final rinse including from about 1.5 grams per liter of ascorbic acid to about 2.5 grams per liter of ascorbic acid is used for preparing base templates before laser finishing.

After yellow faded garments are rinsed with ascorbic acid at about 2.0 grams per liter, the garments acquired a bright blue cast while the yellowness got vanished. Thus, in addition to anti-ozone properties, ascorbic acid inhibits soaping properties of a faded jean. Also light fastness of the material was improved with ascorbic acid in the range from about 0.5 to 1.5 grams per liter.

In an implementation, when ascorbic acid is used in the final rinse, the hydro extraction or spin time is reduced from 15 minutes at 1000 revolutions per minute to 10 minutes at 1000 revolutions per minute in order to allow the ascorbic acid to remain in the garments, rather than being significantly extracted away by the spin. Dryer time and temperature remain the same.

The anti-ozone properties of ascorbic acid are effect for different fabric compositions. In an implementation, a majority of the fabric composition is cotton, since an affinity of ascorbic acid to cotton is enhanced due to its cationic base. In different fabric compositions including cotton, such as (i) cotton and lycra, (ii) cotton, polyester, and lycra, (iii) cotton, viscose, polyester and lycra, all trials exhibited similar and consistent results. No significant differences for the test results were observed.

Figure 26:
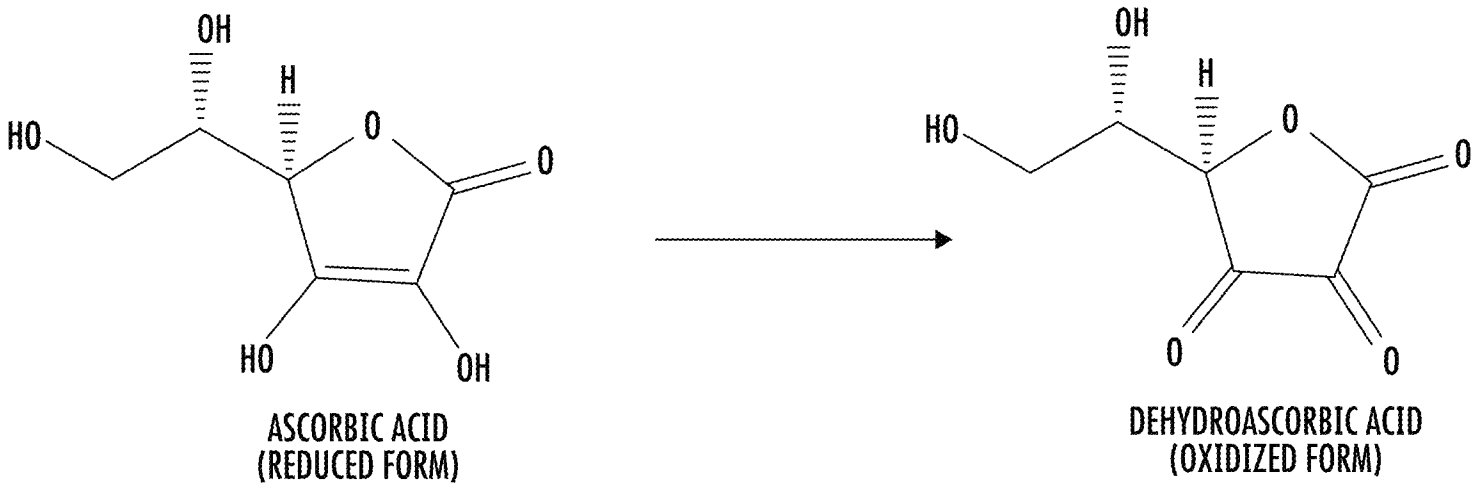
FIG. 26 shows a chemical reaction of ascorbic acid oxidizing into L-dehydroascorbic acid.

FIG. 26 shows a chemical reaction of ascorbic acid oxidizing into L-dehydroascorbic acid. Ascorbic acid has antioxidant properties. Ascorbic acid preserves double bonds while scavenging oxygen radicals and being oxidized. In the softener bath, ascorbic acid is impregnated well into the garments where it penetrates into the fabric while getting deposited as a layer at the same time. Ascorbic acid reacts with ozone at 1:1 stoichiometry.

Based on chemistry, ascorbic acid is oxidized into L-dehydroascorbic acid while removing two protons and two electrons from its structure. The carbon's oxidation number is increased from +1 to +2 while reducing the oxygen of the ozone molecule from 0 to −2, thus completing the redox reaction. Ascorbic acid continues to sacrifice itself to ozone instead of allowing the ozone to react with the indigo dye. Also the byproduct of the oxidized ascorbic acid is completely colorless, so there is no color change to the material. A table B below lists the oxidation and reduction reactions for ozone.

TABLE B

| | |
|---|---|
| Oxidation Reaction | $C_6H_8O_6$ (Ascorbic Acid) → $C_6H_8O_6$ (Dehydroascorbic Acid) + $2H^+ + 2e^-$ |
| Reduction Reaction | $2H^+ + 2e^- + O_3$ (Ozone) → $O_2$ (Oxygen) + $H_2O$ |

In an implementation, food grade ascorbic acid or vitamin C is used in the final rinse (e.g., softener wash) of the base preparation process as an anti-ozone agent. However, food grade ascorbic acid is more expensive than commercial grade ascorbic acid. Since for base preparation, the ascorbic acid will not be consumed by humans, commercial grade ascorbic acid can be used instead. Commercial grade ascorbic acid is significantly less expensive than food grade ascorbic acid.

In an implementation, ascorbic acid as an anti-ozone agent for base preparation can be used instead of other anti-ozone treatments or techniques. In other implementations, ascorbic acid as an anti-ozone agent for base preparation can be used in combination with other anti-ozone treatments or techniques. For example, ascorbic acid can be used with sodium bisulfate, ethylene diamine, amine-based softeners, modified fatty acid softeners, or others, in any combination.

The garments (e.g., assembled garments or bases) or fabric (e.g., fabric rolls) are processed using an anti-ozone agent to provide enhanced anti-ozone properties to prevent color fading or yellowing. The treated garments or fabrics may be stored for subsequent use in laser finishing or traditional finishing. The treated garments may also be stored in inventory (e.g., before being shipped), or shipped to customers, retailers, wholesalers, or stores (e.g., a store displays treated garments on its shelves).

Based on testing, ascorbic acid extends the period before garments show any yellowing by at least three months as compared to products treated using traditional softeners, with and without anti-ozone agents (other than ascorbic acid). Amine-based softeners (e.g., —NH2) may potentially cause yellowing upon regrouping with chlorines, which is typically know as chloramine yellowing. By using ascorbic acid instead of amine-based softeners, yellowing does not occur since ascorbic acid does not have amine groups within its structure.

In various implementations, a garment template can be treated by washing in a wash having about 1.5 to about 2.0 grams per liter of ascorbic acid. A garment template can be treated by washing in a wash having about 2.0 to about 2.5 grams per liter of ascorbic acid. A garment template can be treated by washing in a wash having about 2.5 to about 3.0 grams per liter of ascorbic acid. A garment template can be treated by washing in a wash having about 3.0 to about 3.5 grams per liter of ascorbic acid. A garment template can be treated by washing in a wash having about 2.0 to about 4.0 grams per liter of ascorbic acid. A garment template can be treated by washing in a wash having about 1.5 to about 2.5 grams per liter of ascorbic acid.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A method comprising:

creating a garment template comprising assembling fabric panels of a woven first material into an assembled garment, wherein the first material comprises a warp yarn comprising indigo-dyed cotton yarn, and the fabric panels are sewn together using thread, rinsing the assembled garment in about 1.5 to about 2.5 grams per liter of ascorbic acid, and spin drying the rinsed assembled garment such that the ascorbic acid remains in the assembled garment;

storing the dried rinsed assembled garment as the garment template in a template inventory;

using a laser machine to form a finishing pattern on the garment template by laser, wherein the laser machine marks a surface of the garment according to a digital file input to the laser machine; and using a digital design tool to generate the digital file input used by the laser machine, wherein the digital design tool generates a photorealistic visualization of a finishing pattern of a garment after a postlaser wash on a screen of a design computer and allows editing of the finishing pattern, and the digital design tool executes on the design computer that is separate from the laser machine, the editing permitted by the digital design tool comprises selecting a combination of a garment template and a wear pattern, and saving the combination as the finishing pattern, and a photorealistic visualization of the combination comprises displaying on the screen of the design computer the garment template and wear pattern as a garment of the combination would appear after postlaser wash.

2. The method of claim 1 wherein the garment template comprises before the rinsing the assembled garment, washing the assembled garment in a solution comprising water, enzyme, and pumice stone.

3. The method of claim 1 wherein the garment template comprises before the rinsing the assembled garment, washing the assembled garment in a solution comprising water and bleach.

4. The method of claim 1 wherein the garment template comprises before the rinsing the assembled garment, washing the assembled garment in a solution comprising water and a tint dye.

5. The method of claim 1 wherein the rinsing the assembled garment comprises a softener.

6. The method of claim 1 wherein the garment template is stored in a template inventory at a first facility, which also houses the laser machine.

7. The method of claim 1 wherein the rinsing of the assembled garment and the drying the rinsed assembled garment are performed at a first facility, the garment template is stored in a template inventory at a second facility, which also houses the laser machine, the first facility and second facility are at different geographic locations.

8. The method of claim 1 wherein the editing permitted by the digital design tool comprises moving the wear pattern relative to the garment template.

9. The method of claim 1 wherein the design computer is a tablet computer comprising a touch screen display.

10. The method of claim 1 wherein the photorealistic visualization comprises a three-dimensional rendering.

11. The method of claim 1 wherein the rinsing the assembled garment comprises rinsing the assembled garment in a solution consisting essentially of water and about 1.5 to about 2.5 grams per liter of ascorbic acid.

12. The method of claim 1 wherein the rinsing the assembled garment comprises rinsing the assembled garment in a solution consisting of water and about 1.5 to about 2.5 grams per liter of ascorbic acid.

13. A method comprising:

creating a garment template comprising assembling fabric panels of a woven first material into an assembled garment, wherein the first material comprises a warp yarn comprising indigo-dyed cotton yarn, and the fabric panels are sewn together using thread, rinsing the assembled garment in an anti-ozone agent, and spin drying the rinsed assembled garment such that the anti-ozone agent remains in the assembled garment;

storing the dried rinsed assembled garment as the garment template in a template inventory, whereby the anti-ozone agent prevents yellowing due to exposure to ozone;

using a laser machine to form a finishing pattern on the garment template by laser, wherein the laser machine marks a surface of the garment pattern a pattern according to a digital file input to the laser machine; and using a digital design tool to generate the digital file input used by the laser machine, wherein the digital design tool generates a photorealistic visualization of a finishing pattern of a garment after a postlaser wash on a screen of a design computer and allows editing of the finishing pattern, and the digital design tool executes on the design computer that is separate from the laser machine, the editing permitted by the digital design tool comprises selecting a combination of a garment template and a wear pattern, and saving the combination as the finishing pattern, and a photorealistic visualization of the combination comprises displaying on the screen of the design computer the garment template and wear pattern as a garment of the combination would appear after postlaser wash.

14. The method of claim 13 wherein the rinsing the assembled garment in the anti-ozone agent comprises rinsing in a solution consisting essentially of water and about 2.0 to about 2.5 grams per liter of ascorbic acid.

15. The method of claim 13 wherein the rinsing the assembled garment in the anti-ozone agent comprises rinsing in a solution of water and about 2.5 to about 3.0 grams per liter of sodium ascorbate.

16. The method of claim 13 wherein the rinsing the assembled garment in the anti-ozone agent comprises rinsing in a solution of water and about 3.0 to about 3.5 grams per liter of sodium ascorbate.

17. The method of claim 13 wherein the rinsing the assembled garment in the anti-ozone agent comprises rinsing in a solution of water and about 2.0 to about 4.0 grams per liter of sodium ascorbate.

18. The method of claim 13 wherein the rinsing the assembled garment in the anti-ozone agent comprises rinsing in a solution of water and about 1.5 to about 2.5 grams per liter of sodium ascorbate.

19. The method of claim 13 wherein the creating a garment template comprises before the rinsing the assembled garment in the anti-ozone agent, washing the assembled garment in a solution comprising water, enzyme, and pumice stone.

20. The method of claim 13 wherein the garment template comprises before the rinsing the assembled garment in the anti-ozone agent, washing the assembled garment in a solution comprising water and bleach.

21. The method of claim 13 wherein the garment template comprises before the rinsing the assembled garment in the anti-ozone agent, washing the assembled garment in a solution comprising water and a tint dye.

22. The method of claim 13 wherein the garment template is stored in a template inventory at a first facility, which also houses the laser machine.

23. The method of claim 13 wherein the washing of the assembled garment and the drying the washed assembled garment are performed at a first facility, the garment template is stored in a template inventory at a second facility, which also houses the laser machine, the first facility and second facility are at different geographic locations.

24. The method of claim 13 wherein the anti-ozone agent comprises sodium ascorbate.

25. The method of claim 13 wherein the anti-ozone agent comprises at least one of sodium bisulfate or ethylene diamine.

26. The method of claim 13 wherein the photorealistic visualization generated by the digital design tool comprises a three-dimensional rendering.

27. The method of claim 13 wherein the design computer is a tablet computer comprising a touch screen display.

28. The method of claim 13 wherein the photorealistic visualization comprises a three-dimensional rendering.

29. A method comprising:

creating a garment template comprising assembling fabric panels of a woven first material into an assembled garment, wherein the first material comprises a warp yarn comprising indigo-dyed cotton yarn, and the fabric panels are sewn together using thread, rinsing the assembled garment in an anti-ozone agent, wherein the rinsing the assembled garment in an anti-ozone agent comprises rinsing the assembled garment in a solution consisting essentially of water and about 1.5 to about 2.0 grams per liter of sodium ascorbate, and spin drying the rinsed assembled garment such that the anti-ozone agent remains in the assembled garment;

storing the dried rinsed assembled garment as the garment template in a template inventory, whereby the anti-ozone agent prevents yellowing due to exposure to ozone;

using a laser machine to form a finishing pattern on the garment template by laser, wherein the laser machine marks a surface of the garment according to a digital file input to the laser machine;

using a digital design tool to generate the digital file input used by the laser machine, wherein the digital design tool generates a photorealistic visualization of a finishing pattern of a garment after a postlaser wash on a screen of a design computer and allows editing of the finishing pattern, and the digital design tool executes on the design computer that is separate from the laser machine, the editing permitted by the digital design tool comprises selecting a first combination of a garment template and a first wear pattern, and saving the first combination as a first finishing pattern, and a photorealistic visualization of the first combination comprises displaying on a computer screen the garment template and the first wear pattern as a garment of a first combination would appear after postlaser wash, the editing permitted by the digital design tool comprises selecting a second combination of the garment template, a first wear pattern, and a first tint color, and saving a second combination as a second finishing pattern, and a photorealistic visualization of the second combination comprises displaying on a computer screen the garment template and the first wear pattern along with the first tint color as a garment of the second combination would appear after postlaser wash.

* * * * *